US006749003B2

(12) United States Patent
Kaneto et al.

(10) Patent No.: US 6,749,003 B2
(45) **Date of Patent: *Jun. 15, 2004**

(54) COMPRESSING METHOD FOR CASTING SAND AND DEVICE THEREFOR

(75) Inventors: Kimikazu Kaneto, Toyokawa (JP); Minoru Hirata, Toyokawa (JP); Yutaka Hadano, Toyokawa (JP)

(73) Assignee: Sintokogio, Ltd., Aichi-ken (JP)

( * ) Notice: Subject to any disclaimer, the term of this patent is extended or adjusted under 35 U.S.C. 154(b) by 143 days.

This patent is subject to a terminal disclaimer.

(21) Appl. No.: 10/009,633

(22) PCT Filed: Apr. 13, 2001

(86) PCT No.: PCT/JP01/03188

§ 371 (c)(1),
(2), (4) Date: Dec. 12, 2001

(87) PCT Pub. No.: WO01/78921

PCT Pub. Date: Oct. 25, 2001

(65) Prior Publication Data

US 2003/0010468 A1 Jan. 16, 2003

(30) Foreign Application Priority Data

| | | |
|---|---|---|
| Apr. 13, 2000 | (JP) | 2000-111700 |
| May 19, 2000 | (JP) | 2000-149055 |
| Jun. 9, 2000 | (JP) | 2000-174159 |
| Jun. 16, 2000 | (JP) | 2000-180920 |

(51) Int. Cl.[7] ..... B22C 15/28

(52) U.S. Cl. ..... 164/195; 164/37; 164/172; 164/239

(58) Field of Search ..... 164/37, 172, 195, 164/200, 201, 202, 207, 237, 239

(56) References Cited

U.S. PATENT DOCUMENTS

| | | | | |
|---|---|---|---|---|
| 3,041,685 | A | * 7/1962 | Taccone | 164/37 |
| 4,598,756 | A | * 7/1986 | Fuchigami et al. | 164/37 |
| 4,702,301 | A | * 10/1987 | Buhler | 164/168 |
| 4,915,159 | A | * 4/1990 | Damm et al. | 164/456 |
| 5,476,136 | A | * 12/1995 | Leutwiler et al. | 164/195 |
| 5,682,941 | A | * 11/1997 | Oda et al. | 164/154.2 |
| 6,176,296 | B1 | * 1/2001 | Asai | 164/207 |
| 6,470,953 | B1 | * 10/2002 | Hirata et al. | 164/37 |

FOREIGN PATENT DOCUMENTS

| | | |
|---|---|---|
| JP | 7-232234 | 9/1995 |
| JP | 9-225588 | 9/1997 |

* cited by examiner

*Primary Examiner*—M. Alexandra Elve
*Assistant Examiner*—Len Tran
(74) *Attorney, Agent, or Firm*—Finnegan, Henderson, Farabow, Garrett & Dunner LLP

(57) ABSTRACT

A method for introducing and compacting molding sand S in a mold space defined by a pattern plate (10*a*), a lower auxiliary frame (16*b*), a flask (18), a filling frame (20), and multi-segmented squeeze feet (36*a*). First, the molding sand S is introduced into the mold space. The squeeze feet (36*a*) are then lowered to apply a first squeeze to the mold sand S in the mold space under a condition wherein at least the lower frame (16*a*) cannot be lowered. The squeeze feet (36*a*) are then lowered to apply a second squeeze to the mold sand S in the mold space under a condition wherein the lower frame (16*a*), the flask (18), and the filling frame (20) can be lowered.

11 Claims, 26 Drawing Sheets

COMPRESSING METHOD FOR CASTING SAND AND DEVICE THEREFOR

FIELD OF THE INVENTION

This invention generally relates to molding a sand mold, and in particular to a method and apparatus for compacting molding sand that is introduced into a mold space. Further, this invention also relates to a method for removing the sand mold from the mold space.

BACKGROUND OF THE INVENTION

A conventional method for molding a sand mold by compacting or squeezing molding sand that is introduced into a mold space that is defined by a pattern plate, flask, and rams is known. In this method, the molding sand is compacted, while the pattern plate and the rams contact each other. Because such a method needs large cylinders for vertically moving the pattern plate, the height of a molding machine that employs them must be increased proportionately. Thus, what is needed is a means for enabling the installation of the resulting higher machine. For example, a pit should be provided on a floor.

Another conventional squeeze molding process with a leveling frame is also available. In this process, molding sand is introduced into a mold space defined by a flask, a pattern plate, and a lower auxiliary frame. Then a pressure head located at the upper position (upper head) and a lower head at the lower position (lower head), which are driven by the corresponding cylinders, compact the molding sand in the mold space. This molding process includes a method of removing a sand mold from the mold space. In this process, the lower head is lowered to remove a pattern from the sand mold, and then the upper head is lifted. The flask is then released from its fixed condition by a fixing-and-releasing mechanism. The flask, which has been used to mold the sand mold, is moved onto the following station by a conveyor. The removal of the sand mold is performed when the cylinders of the lower head are fully extended. When the pattern is removed from the sand mold, however, one problem occurs. That is, the removal of the sand mold is inaccurate. This results in the surface of the mold collapsing. Thus a faulty mold is produced.

Generally, other conventional methods of removing a sand mold also use cylinders. The removal is carried out when the cylinders are extended. Because guide pins, which are associated with the cylinders, may lack rigidity, the removal of the sand mold often fails. Unfortunately, a guide pin having a sufficient rigidity may have an increased diameter and an increased cost resulting from it.

In a conventional molding machine, to form a sand mold in a flask, molding sand is introduced into a space defined by a pattern plate, a flask, and a filling frame, where the flask and the filing frame overlap on the top of the pattern plate, and then the introduced molding sand is smoothed by scraping. A planar squeezing plate or multi-segmented squeezing feet compact the smoothed molding sand.

The smoothing of the molding sand by scraping, however, spills a relatively high amount of the molding sand. Further, with the planer squeezing plate, the compacting is not made uniform between an upper portion of a pattern of the pattern plate and a lower portion of it. In particular, the compacting of the lower portion of the pattern may be insufficient. With the multi-segmented squeezing feet, because the top surface of the sand mold as made is not planar, its rough surface must be ground after the molding process has been completed. This will result in a waste of the molding sand.

SUMMARY OF THE INVENTION

One object of the present invention provides a method and apparatus for compacting introduced molding sand in a mold space that is defined by a pattern plate, a flask, and a compacting means. The method and apparatus enable the molding sand to be generally compacted at a predetermined hardness without large cylinders (e.g., each of them has a height that needs a pit for enabling the molding machine to be installed).

Another object of the invention provides a method of removing a sand mold with a great accuracy.

Another object of the invention provides a method and apparatus for molding a sand mold where the amount of the spilled or ground molding sand is significantly reduced, all the molding sand of a sand mold is uniformly compacted, sufficient rigidity can be obtained, the sand mold can also be accurately removed, and the cost can be reduced.

One aspect of the invention provides an apparatus for introducing molding sand into a mold space in which a sand mold is produced, and for compacting the introduced molding sand in the mold space.

The apparatus includes a pattern plate having a pattern, a vertically-movable, lower auxiliary frame for surrounding the pattern plate, a vertically-movable flask, which is placed on the lower auxiliary frame in such a manner that it surrounds the pattern, a vertically-movable filling frame disposed on the flask, and a vertically-movable compacting means located above the flask in such manner that the lower portion thereof is inserted into the filling frame. The pattern plate, the lower auxiliary frame, the flask, the filling frame, and the compacting means together define a mold space. The apparatus also includes means for introducing molding sand into the mold space.

First, the compacting means is lowered in a condition where at least the lower auxiliary frame cannot be lowered, to compact the molding sand in the mold space (the first squeeze). Following the primary squeeze, the compacting means is further lowered, in a condition in which the filling frame, the lower subsidiary frame, and the flask can be made to move lower, to further compact the molding sand in the mold space (the second squeeze).

Preferably, the force of the compacting of the second squeeze is greater than that of the first squeeze.

The compacting means may be multi-segmented squeeze feet.

In the method for removing a sand mold of the invention, a mold space is defined by a horizontally fixed pattern plate having a pattern, a vertically-movable, lower auxiliary frame surrounding the pattern plate, a vertically-movable flask, which is placed above the lower auxiliary frame in such a way that it surrounds the pattern, a vertically movable filling frame placed above the flask, and a compacting means mounted on a vertically-movable supporting means that is located above the flask in such a manner that the lower portion of the compacting means is inserted into the filling frame. In this method, the compacting means provides two steps in the compacting, that is, first and second squeezes, applied to the introduced molding sand in the mold space. Then the produced sand mold is removed.

The method comprises the steps of lifting the lower auxiliary frame at a predetermined velocity to apply an upward force to the supporting means via the filling frame, while lifting a flask, in which a sand mold has been produced, the compacting means, and the filling frame, in unison, so as to separate the flask from the pattern plate, and to remove the separated flask.

The method may be applicable to a sand mold that is molded by means of an "aeration filling." The term "aeration" refers herein to an action to fluidize the molding sand to be introduced into the mold space with compressed air. Further, the term "aeration filling" refers herein to introducing the molding sand that is floated or fluidized by the aeration into the mold space by applying more compressed air.

An apparatus for molding the sand mold of this invention includes a base having a substantially square cross section, and at least three rod-like elements standing on the base. At least two among the at least three rod-like elements are upwardly-extending cylinders, each having a piston rod. The distal ends, which include the distal ends of the piston rods of two cylinders, of the at least three rod-like elements, are attached to supporting means that can be vertically moved by driving the upwardly-extending cylinders. The supporting means supports a sand hopper for containing the molding sand. The sand hopper includes aeration means for aerating the contained molding sand with an airflow of compressed air, and a plurality of nozzles for discharging the aerated molding sand by an additional airflow of compressed air. Vertically movable, multi-segmented squeeze feet are mounted on the lower portion of the sand hopper at locations which each are adjacent to the corresponding nozzle. The apparatus also includes a vertically movable filling frame surrounding the nozzles and the squeeze feet, and pattern carrying means. The filling frame includes vent holes to vent, with the molding sand, the compressed air that is discharged from the nozzles. The pattern carrying means includes a pair of pattern carriers that each carries a pattern plate. The pattern carrying means alternately moves on and off the patterns to a location that is aligned with the filling plate above the base.

The discharged molding sand from the nozzles is introduced into a mold space defined by the pattern plate, the filing frame, and the squeeze feet. The squeeze feet then compact the molding sand.

Two of the upwardly-extending cylinders may be located on corners of one diagonal line on the base. In this case, two other upwardly-extending cylinders may be located on corners of another diagonal line on the base. That is, the four cylinders acting as the rod-like elements may be employed. Alternatively, a pair of holders, each of which has vertically slidable guide pins fitted therein, may be located on the corners of the second diagonal line on the base.

The rod-like elements may be three upwardly-extending cylinders that are arranged to form a triangle on the base. In this case, the carrying means can be a turntable that rotates around the one cylinder, which as the vertex of the triangle forms the axis of rotation.

In each embodiment, separated and vertically-movable squeeze feet may be employed. The squeeze surface that is formed by the lower ends of the squeeze feet may have a protruding or receding profile when the mold space is being formed, and may have a planer profile when the compacting is completed.

BRIEF DESCRIPTION OF THE DRAWINGS

The accompanying drawings, which are incorporated in and constitute a part of the specification, schematically illustrate a preferred embodiment of the present invention, and together with the general description given above and the detailed description of the preferred embodiment given below serve to explain the principles of the invention.

FIGS. 1 to 6 are schematic, elevational and sectional views of the apparatus of FIG. 1 to explain the operations of it.

FIG. 2 shows the step where a mold space to mold a sand mold is defined.

FIG. 3 shows the step where molding sand is introduced into the mold space.

FIG. 4 shows the step where the molding sand in the mold space undergoes the first squeeze.

FIG. 5 shows the step where the molding sand in the mold space undergoes the squeeze.

FIG. 6 shows the step where the sand mold is removed from a pattern plate.

DESCRIPTION OF THE PREFERRED EMBODIMENTS

Figure 1:
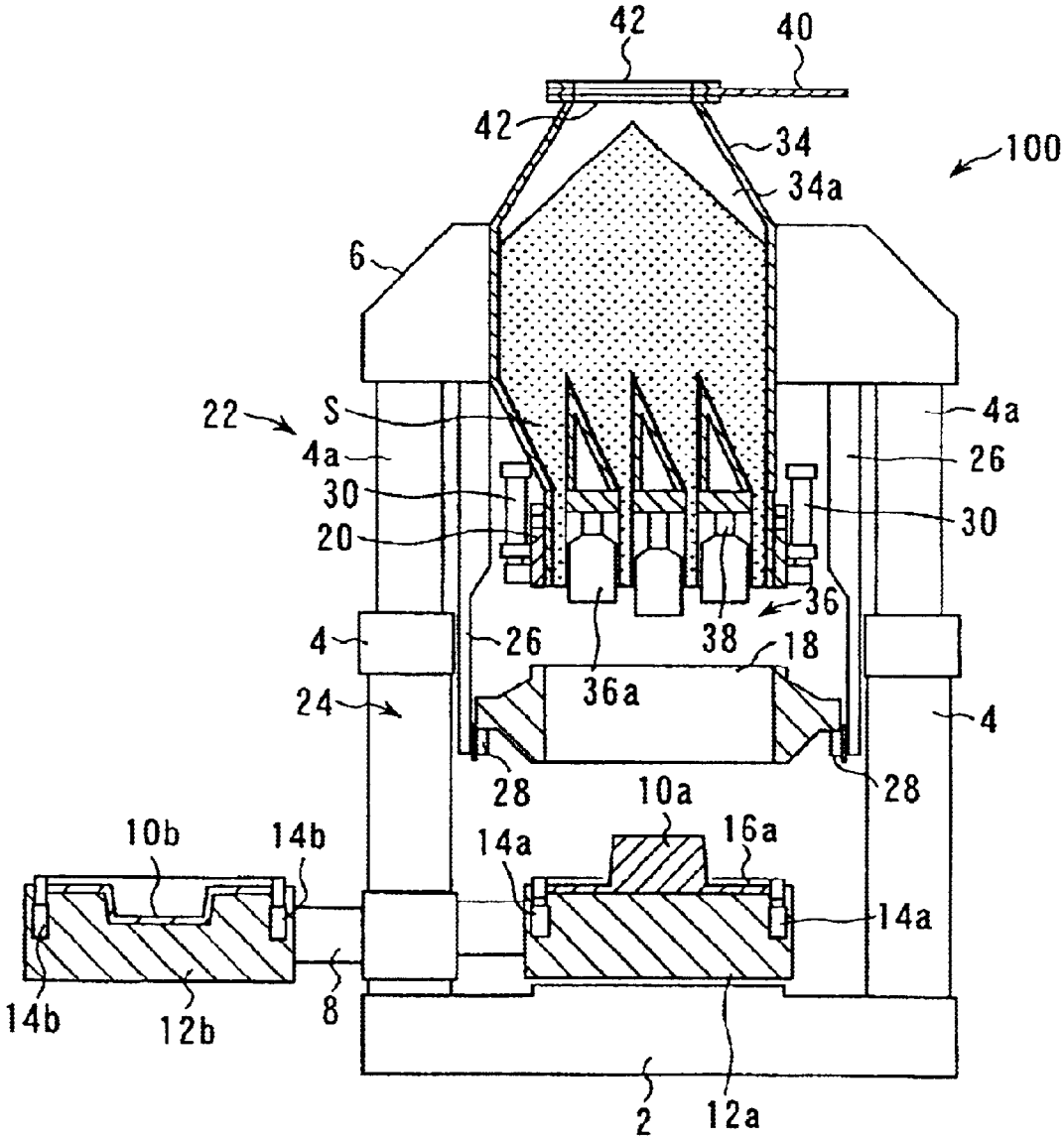
FIG. 1 is a schematic, elevational, and sectional view of the apparatus of the first embodiment of the present invention.

In reference to the drawings, the same elements or similar functional elements are designated by like reference numbers. First, below the elements substantially in common and the functions of the apparatuses of the embodiments of the invention will be explained, mainly in reference to FIG. 1. As shown in FIG. 1, a base 2 is fixed on a floor. A plurality of upwardly-extending, main cylinders (hydraulic cylinders) 4 are standing on the base 2. Typically, two or four cylinders 4 may be employed, but two opposed cylinders are employed in FIG. 1. The pair of the main cylinders 4 are provided with piston rods 4*a*, each of which can be upwardly extended. The distal ends of the piston rods 4*a* are mounted on a rigid, supporting frame 6 in such a manner that the expanding and retracting actions of the cylinders 4 cause it to move vertically.

The number 8 near the base 2 designates a pattern changer for changing patterns. In the embodiment of FIG. 1, the pattern changer is a turntable 8, which is extended to the right and left sides from one main cylinder 4 (the left one in FIG. 1) that is located in the center of the turntable 8. On the base portion of the left cylinder, the center of the turntable 8 is rotatably mounted in such a manner that it can be intermittently rotated horizontally. Alternatively, the turntable 8, which acts as the pattern changer, may be replaced with a linear reciprocating table that reciprocates linearly, i.e., it moves forward and backward of the machine.

On the two respective sides of the turntable 8, pattern plate carriers 12*a* and 12*b*, which support pattern plates (the upper pattern plate and the lower pattern plate) 10*a* and 10*b* thereon in substantially horizontal positions, respectively, are supported by a plurality of springs, e.g., spring plates (not shown) in such a manner that the pattern carriers are lifted about 5 mm from the base. Thus, on the base 2 there is a gap of about 5 mm between each pattern plate carrier and the base 2.

The turntable 8 alternatively changes the pattern plates 10*a*, 10*b* in such a manner that one is moved to the center area on the base 2, the other being moved off therefrom. A plurality of vent plugs (not shown) are embedded in the upper surfaces of the pattern plates 10*a*, 10*b*.

A plurality of upwardly-extending, rising cylinders 14*a*, 14*b* are embedded in the pattern carriers 12*a* and 12*b* at the peripheries of the four corners of the pattern plates 10*a* and 10*b*. The lower subsidiary or auxiliary frames (lower frames) 16*a* and 16*b*, each of which encloses the periphery of the corresponding pattern plate 10*a* or 10*b* such that the lower frame can be vertically and slidably moved, are attached to the distal ends of the rising cylinders 14*a*, 14*b*. The tops of the lower frames 16*a* and 16*b* slightly protrude from the top surfaces of the peripheries of the pattern plates 10*a* and 10*b* when the corresponding cylinder 14*a* or 14*b* is in its extended position, and is at substantially the same level as the top surfaces of the peripheries of the pattern plates 10*a* and 10*b* when the corresponding cylinder 14*a* or 14*b* is in its retracted position (see FIG. 5). The power of the vertically-rising cylinder 14*a* (or 14*b*) is sufficient to lift the lower frame 16 (or 16*b*) and a flask 18 with a contained sand mold so as to remove the sand mold, but insufficient to lift the corresponding main cylinder 2.

A filling frame 20, having vent holes 32 (FIG. 2), which communicates with a discharge control chamber (not shown), is overlapped on the flask 18. Below, the ways to support the filling frame 20 will be explained in each of the descriptions of the embodiments. A vertically movable, compacting mechanism 22 is located above the filling frame 20. The lower portion of the compacting mechanism 22 is vertically and slidably inserted in the filling frame 20.

The compacting mechanism 22 includes a sand hopper 34, which is mounted through the center of the frame 6, a squeezing element, generally denoted by the number 36 and suspended from the lower portion of the sand hopper 34, and an elevation mechanism 38 for vertically moving the squeezing element 36 in such a manner that it compacts the molding sand.

The sand hopper 34 is provided respectively at its upper and lower portions with a container section 34*a* for containing the sand, and nozzles (not shown in FIG. 1), which can be inserted into the filling frame 20. The top of the sand hopper 34 provides an opening 42. A sliding gate 40 can open and close the opening 42 such that sand is introduced into the sand hopper 34 by a known device via the opening 42 when the gate 40 is opened.

In reference to FIGS. 1 to 6, the molding machine for molding a sand mold of the first embodiment of the invention is now explained.

First, the manner for supporting the flask 18 of the molding machine, generally designated by the number 100, is explained. The flask 18 can be moved along a path which is extended in line with the forward and backward directions (the vertical direction in the drawing in FIG. 1) of the machine 100, by a conveyor 24. The conveyor 24 comprises a pair of vertical members 26, which oppose each other, mounted on the supporting frame 6, and a plurality of flanged rollers 28 rotatably mounted on each vertical member 26 in line with the forward and backward directions (the vertical direction in the drawing in FIG. 1) at appropriate intervals.

The manner for supporting the filling frame 20 of the machine 100 is now explained. On the two sides of the compacting mechanism 22, a pair of downwardly-facing cylinders 30 for the filling frame are mounted. The filling frame 20 is secured to the distal ends of the piston rods of the cylinders 30 in such a way that the filling frame 20 can be vertically moved by driving the cylinders 30.

Now the squeezing element 36 employed in the machine 100 is explained. One example of the squeezing element 36 in this embodiment includes a plurality of square-like squeeze feet 36*a* so that the portions to be compacted in the molding sand are multi-segmented. Alternatively, a single squeezing element whose integral portion is to compact the molding sand may be employed. Alternatively, another design of a squeezing element, whose rear surface has a flexible membrane on which the compressed fluid is applied in order to enhance the flexibility of the squeezing element, may be employed. Because the designs of these squeezing elements are well known to those skilled in the art, no details of them will be explained herein.

From the state shown in FIG. 1, the processes for introducing molding sand into a desired mold space to produce a sand mold and for compacting molding sand in the mold space is now explained.

The elevation mechanism 38 of the compacting mechanism 36 causes the vertical movement of the squeeze feet 36*a* to form a desired gap between the lower-end surface (the squeeze surface), formed by the squeeze feet 36*a*, and the opposing pattern of the pattern plate 10*a*, which is located under the squeeze feet. In this state, the profile of the squeeze surface that is formed by all of the squeeze feet 16 takes on a convex- and concave-shaped profile that matches that of the opposing pattern plate 10*a*, which is located under the squeeze feet 36*a*.

Simultaneously, the rising cylinders 14*a* are extended to lift the lower frame 16*a*. As noted above, the height of the top of the lower frame 16*a* (whose top slightly protrudes from the top surface of the periphery of the pattern plate 10*a*), which depends on the rising cylinders 14*a*, and the height of the pattern carrier 12*a* (lifted about 5 mm from the base 2), are adjusted.

Figure 2:
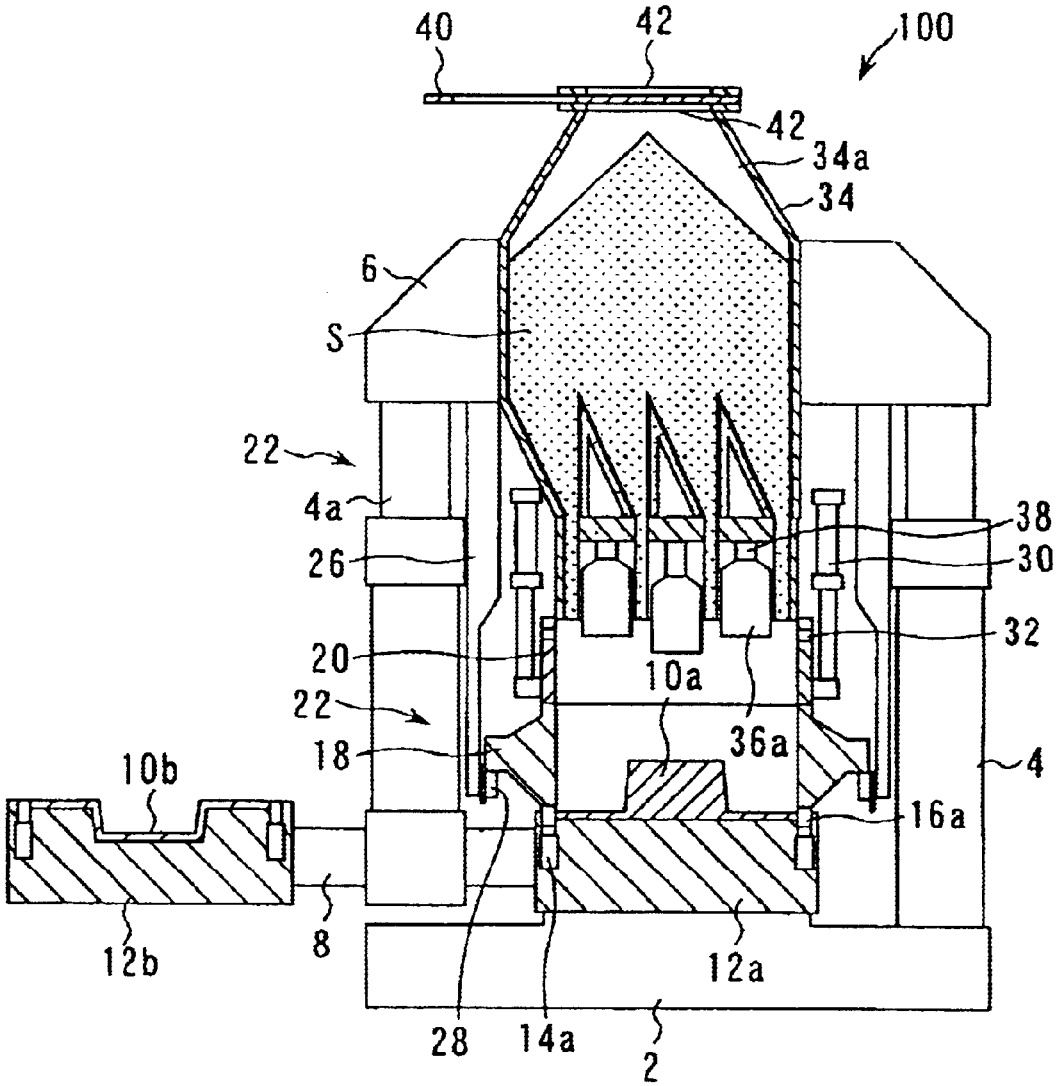

Under this condition, as shown in FIG. 2, the main cylinders 4 are retracted by a required stroke to lower the supporting frame 6 and the compacting mechanism 22 etc. in such a manner that the flask 18 is placed on the lower frame 16*a*. Then the cylinders 30 of the filling frame 20 are extended in such a manner that the filling frame 20 is overlapped on the flask 18, thereby the mold space being defined.

Figure 3:
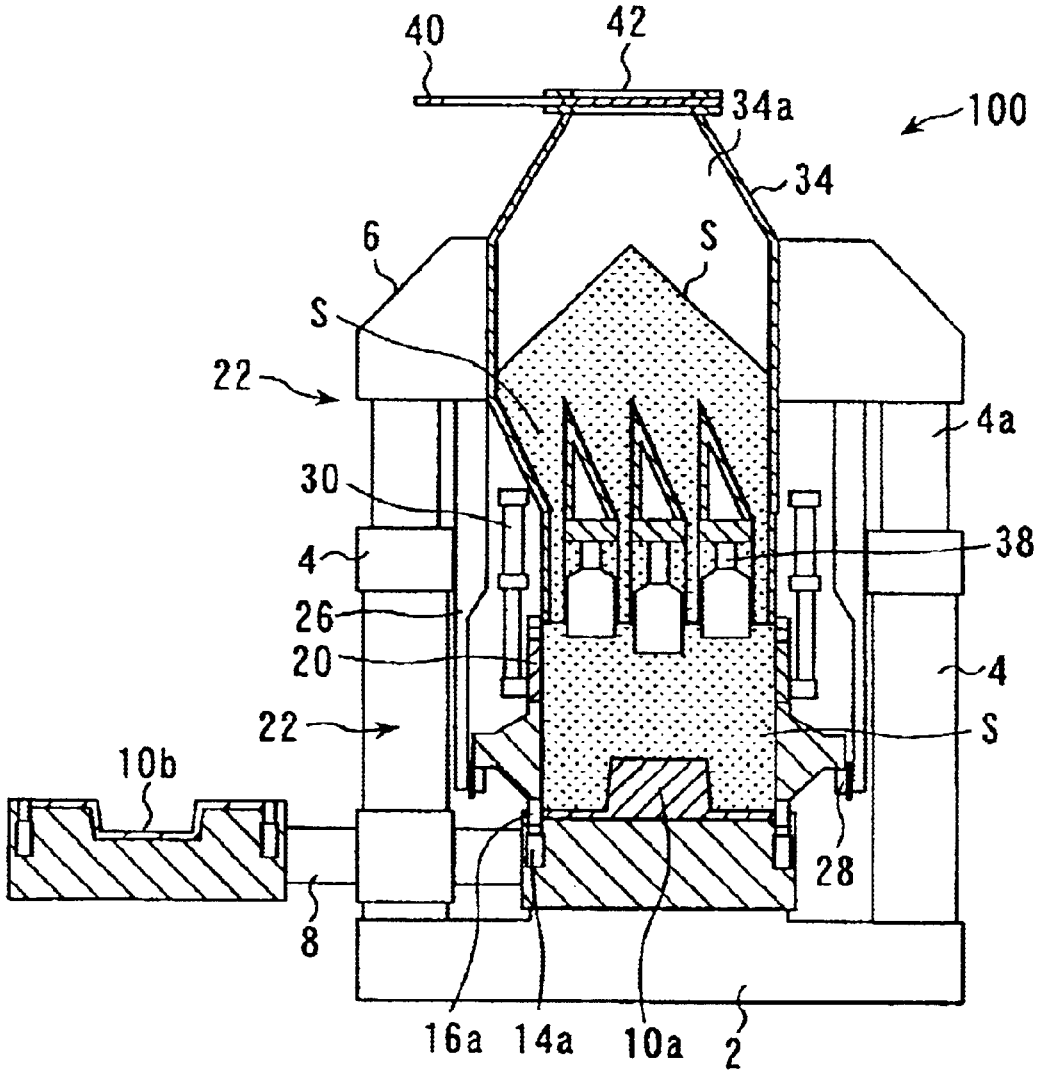
Figure 4:
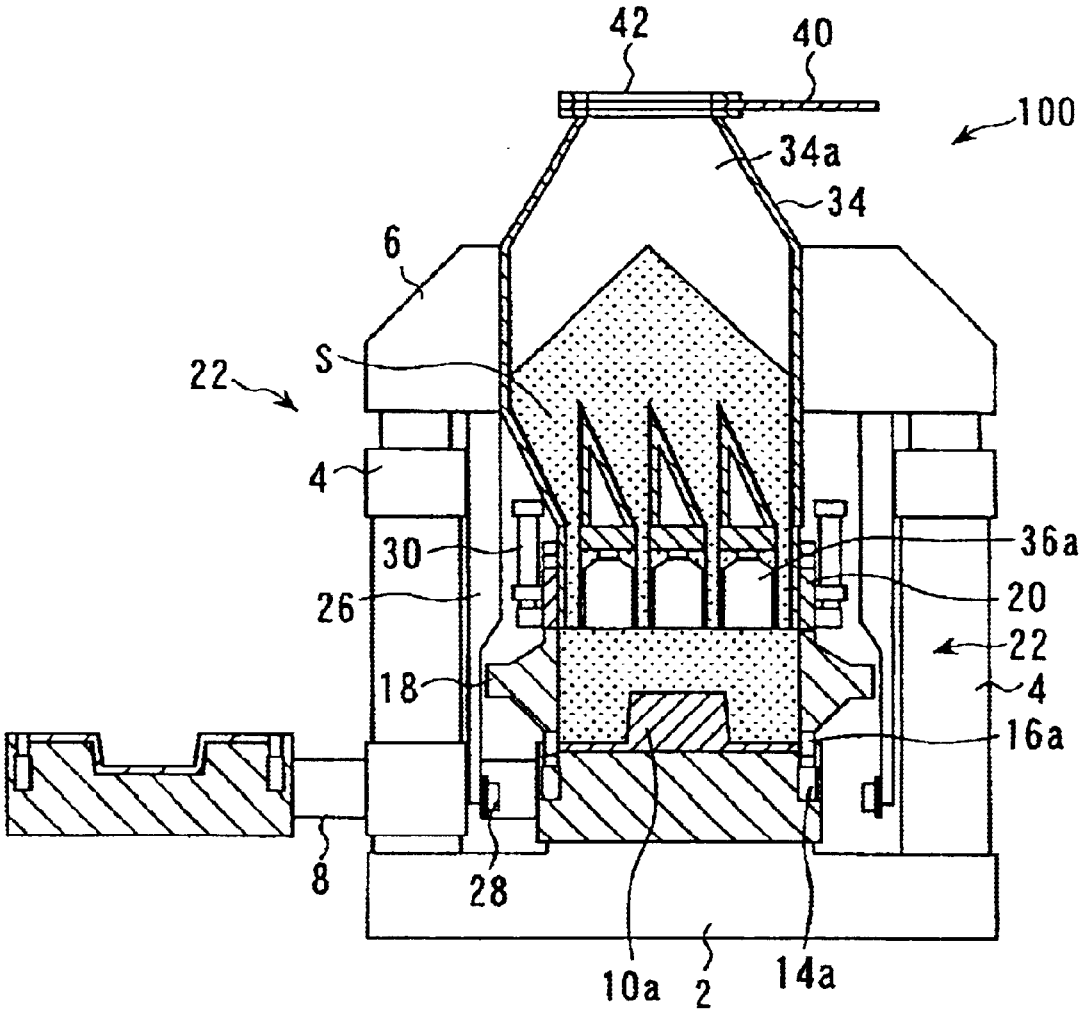

As shown in FIG. 3, then the molding sand held in the sand hopper 34 of the compacting mechanism 22 is blown and introduced into the mold space. The main cylinders 4 are then set so that the actuating fluid (typically, actuating oil) in them cannot be released from the releasing sides of them during their retraction such that the lower frame 16*a* cannot be lowered. The main cylinders 4 are also set so that the actuating oil in them can be released from the releasing sides of them while the cylinders 30 of the filling frame are retracted such that the filling frame 20 can be lifted in relation to the lower portion of the sand hopper 34. Under this condition, as shown in FIG. 4, the rising cylinders 14*a* are retracted to lower the compacting mechanism 22 by a desired length via the frame 6. Thus, the molding sand in the mold space is compacted (the primary squeeze). In this case, preferably substantially all the squeeze feet 36*a* return to substantially the same height, which is caused by the force of the repulsion of the molding sand, and their squeeze surface is lowered to substantially the same height as the top surface of the flask 18. Therefore, the squeeze surface is planar when the compacting has been completed.

Figure 5:
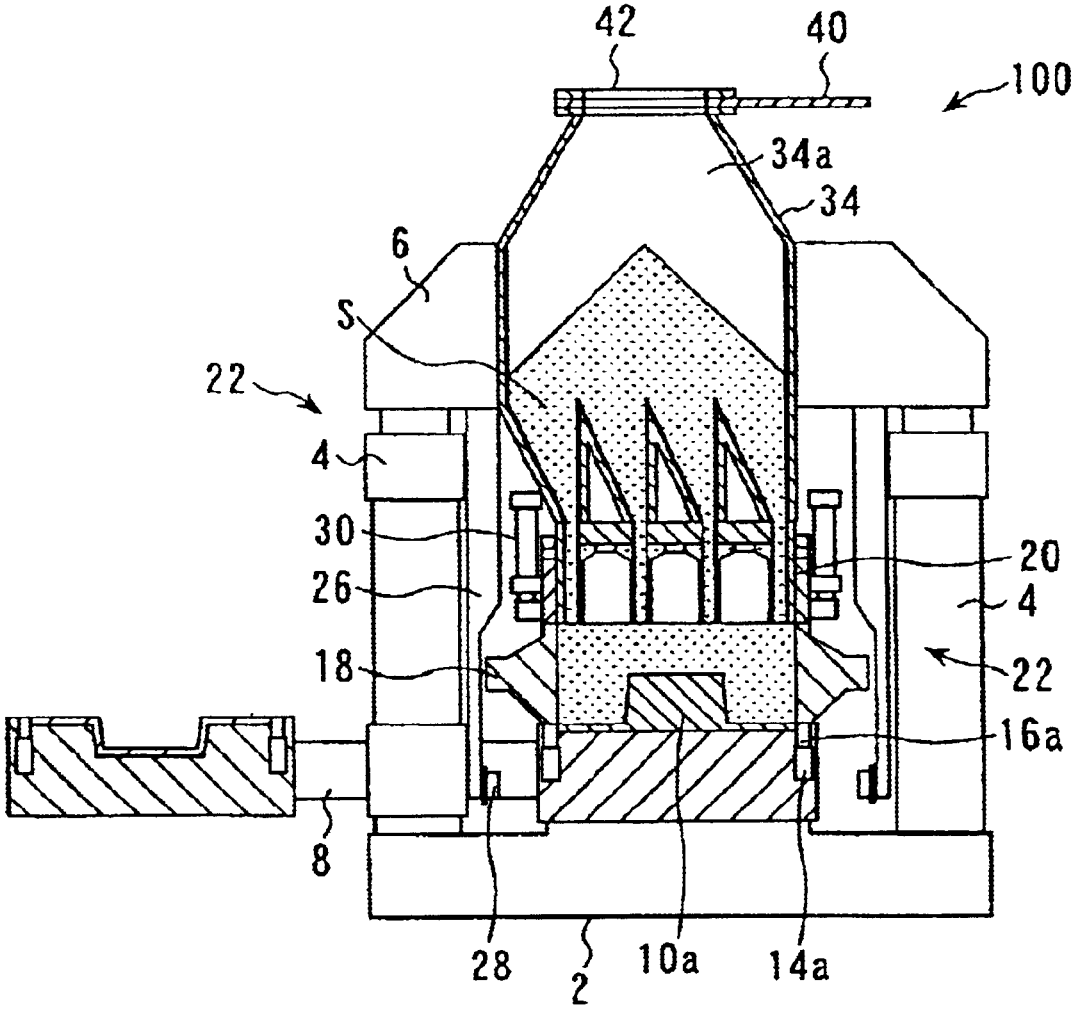

The main cylinders 4 are then set so that the actuating oil in them can be released from their releasing sides while they are being retracted such that the lower frame 16*a* cannot be lowered. Under this condition, as shown in FIG. 5, the rising cylinders 14*a* are further retracted to further lower the compacting mechanism 22, the flask 18, and the filling frame 20. In this state, the leveling frame 16*a* is lowered via the flask 18, the filling frame 20, and the cylinders 30 of the filling frame 20. This causes the molding sand and the flask 8 to be lowered, in unison, to press against the pattern plate 1. Therefore, the molding sand is further compacted (the second squeeze). In this state, preferably the bottom surface of the molding sand in the flask 18 is at substantially the same level with that of the flask 18. Although the pressure of the second squeeze may be the same as that of the primary squeeze, preferably the pressure of the second squeeze is higher than that of the primary squeeze.

Figure 6:
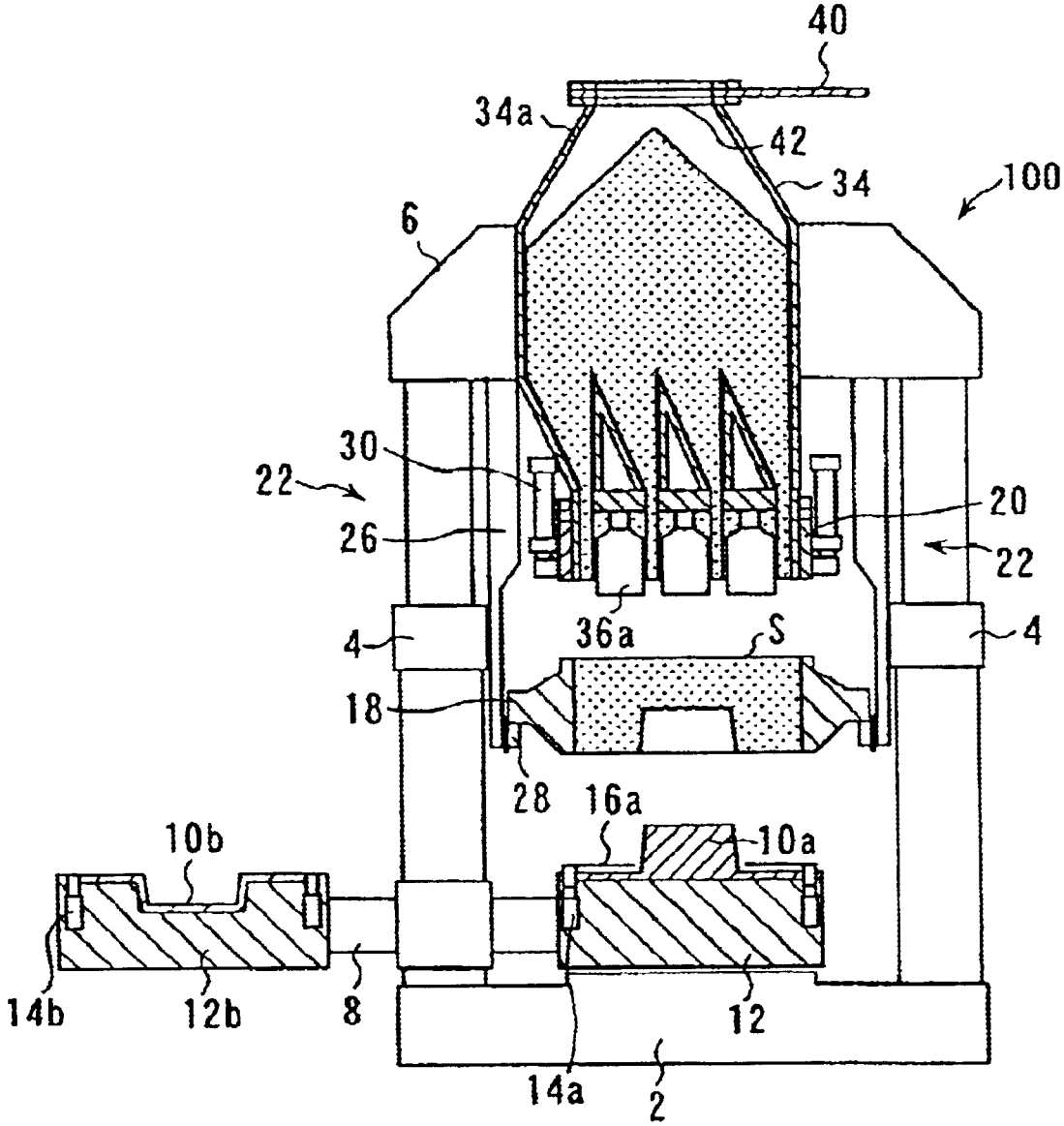

After the compacting of the molding sand has been completed, the main cylinders 4 are set so that the actuating oil in them cannot be released from their releasing sides when the cylinders 30 of the filling frame are extended. Under this condition, as shown in FIG. 6, the main cylinders 4 are extended, and the rising cylinders 14*a* are also extended to lift the compacting mechanism 22 and filling frame 20. The flanged rollers 28 are engaged with the flask 18 containing the molded sand mold so as to lift and remove them from the pattern plate 10*a*. After this step, the turntable 8 is horizontally rotated 180 degrees so that another pattern plate 10*b* is moved in immediately under the compacting mechanism 22. Thus, one cycle is completed. If a new empty flask 18 is then moved onto the conveyor 24, the process as shown in FIGS. 1–6 as described above can be repeated.

As described above, with this embodiment, substantially all of the molding sand in the mold space can be compacted at a predetermined hardness without necessitating large fluid cylinders that need a pit to enable them to be installed.

In reference to FIGS. 7–14, the second embodiment of the invention is now explained. On the two sides of the compacting mechanism 22, a pair of downwardly-facing cylinders 30 for the filling frame are mounted. In this embodiment, the filling frame 20 is secured to the distal ends of the piston rods of the cylinders 30 in such a manner that the filling frame 20 can be vertically moved by driving the cylinders 30. As the squeezing element 36, this embodiment employs multi-segmented squeeze feet 36*a*. With the conveyor 24, which is similar to that of the first embodiment, the flask 18 can be moved forward and backward from a molding machine 110.

Figure 7:
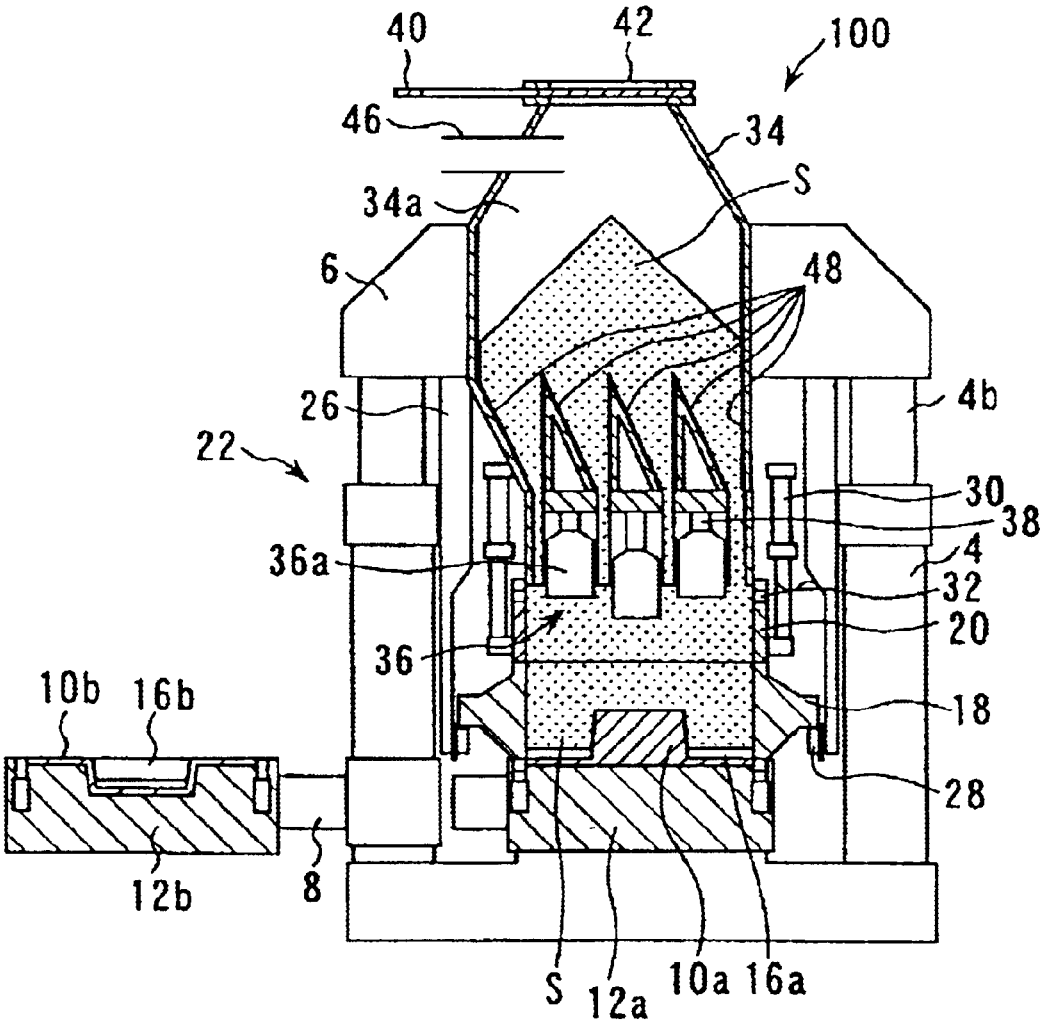
FIG. 7 is a schematic, elevational, and sectional view of the apparatus of the second embodiment of the present invention.
Figure 8:
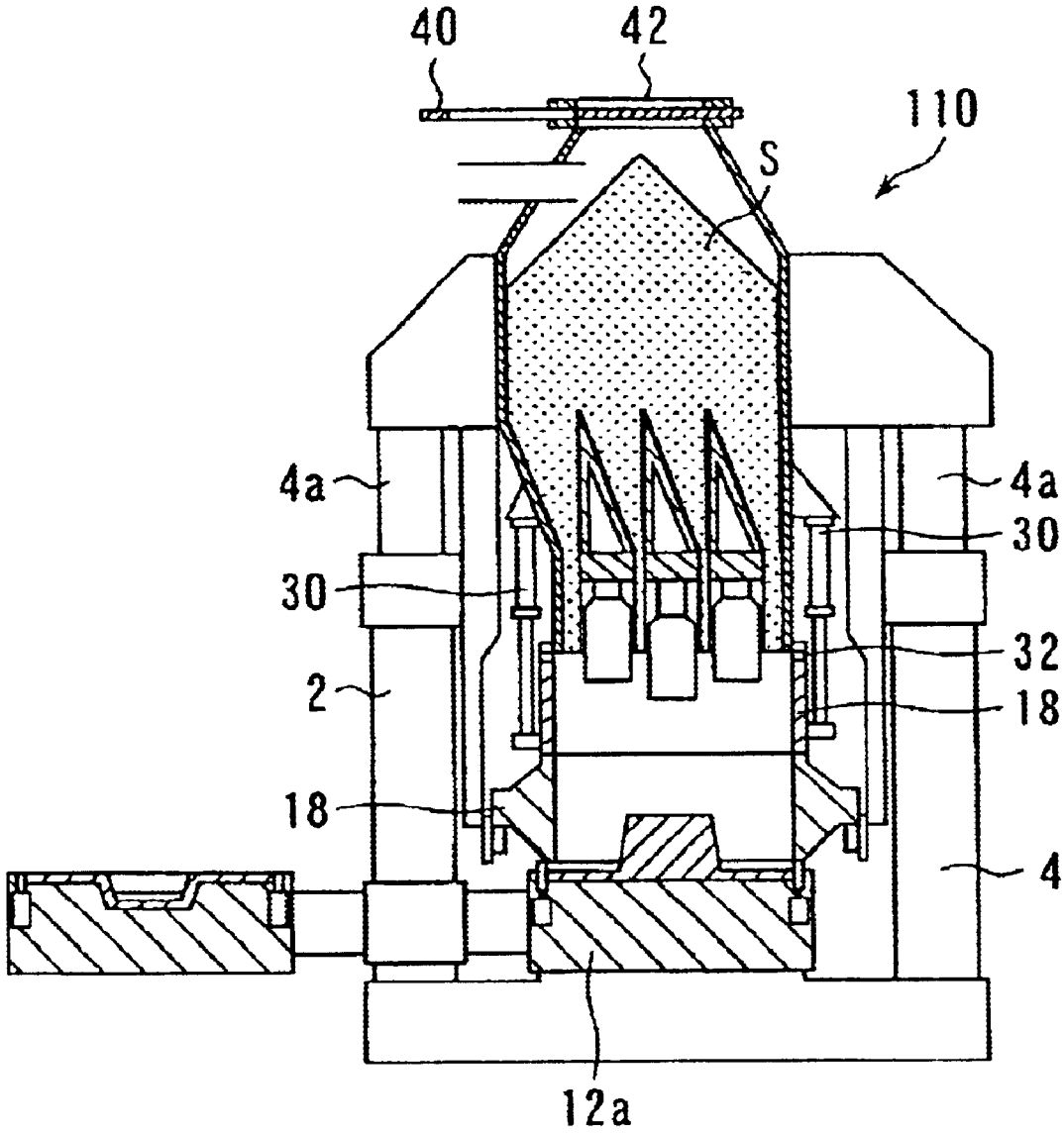
FIG. 8 is schematic, elevational and sectional view of the apparatus of FIG. 7 to explain the operation of it, where a mold space to mold a sand mold is defined.

In FIG. 7, the molding machine, generally denoted by the number 110, includes the sand hopper 34. Its lower end is provided with a plurality of nozzles 44 for discharging the sand in such a manner that the nozzles surround the periphery of the squeeze feet 36*a*. The nozzles 44 are arranged so that the height of the lower-end surface of the squeeze feet 36*a* is the same as that of the nozzles 44 when the squeeze feet 36*a* are in their lifted position.

A pipe 46, for introducing compressed air, is connected to the upper periphery of the sand container 34*a* of the sand hopper 34. The pipe 46 introduces a first airflow of compressed air at a relatively low pressure. It is introduced into the sand container 34*a* via a valve (not shown) from a source (not shown) of compressed air such that the molding sand contained in the sand container 34*a* is introduced into the mold space through the nozzles 44.

The lower peripheral portions and the lower inner portions of the sand container 34*a* of the sand hopper 34 are provided with a plurality of air chambers 48 for supplying second airflows of compressed air at a relatively low pressure into the sand container 34*a* so as to float or fluidize the molding sand (this floating or fluidizing of the molding sand is herein called "aeration"). The chambers 48 communicate with a source (not shown) of compressed air via one valve (not shown).

Preferably, the pressure of both the first airflow of compressed air, from the pipe 46, and the second airflow of compressed air, from the air chambers 48, is 0.05 to 0.18 MPa.

Now the operation of the molding machine 110 is explained. In FIG. 7, the sand hopper 34 is filled with molding sand S. The profile of the lower-end surface (the squeeze surface), formed by all of the squeeze feet 36*a*, takes on a protruding or receding profile that matches that of the opposing, upper surface of the pattern plate 10*a*, which is located under the squeeze feet 36*a*. The conveyor 24 carries an empty flask 18. In this state, the heights of the pattern carrier 12*b* and the lower frame 16*a* are set as described in the first embodiment, which refers to FIG. 1.

In this state, the sliding gate 40 is actuated to close the opening 42. The cylinders 30 of the filling frame 20 are then extended to lower it such that it is pushed onto the upper surface of the flask 18, so they are then closely contacted. Simultaneously, main cylinders 4 are retracted such that the flask 20 is pushed toward the lower frame 16*a* that protrudes from the top surfaces of the periphery of the pattern plate 10*a*. At that time the pattern plate carrier 12*a* is pushed toward the base 2 against the springs, which are described above, but not shown (FIG. 8). Under this state, a mold space is defined by the pattern plate 10*a*, the leveling frame 16*a*, the flask 18, the filling frame 20, and squeeze feet 36*a*. In this mold space, the lower-end surface (squeeze surface) that is formed by all of the squeeze feet 36*a* has a protruding or receding profile that matches the protruding or receding profile of the pattern plate 1*a*, which is located under the squeeze feet 36*a*.

Figure 9:
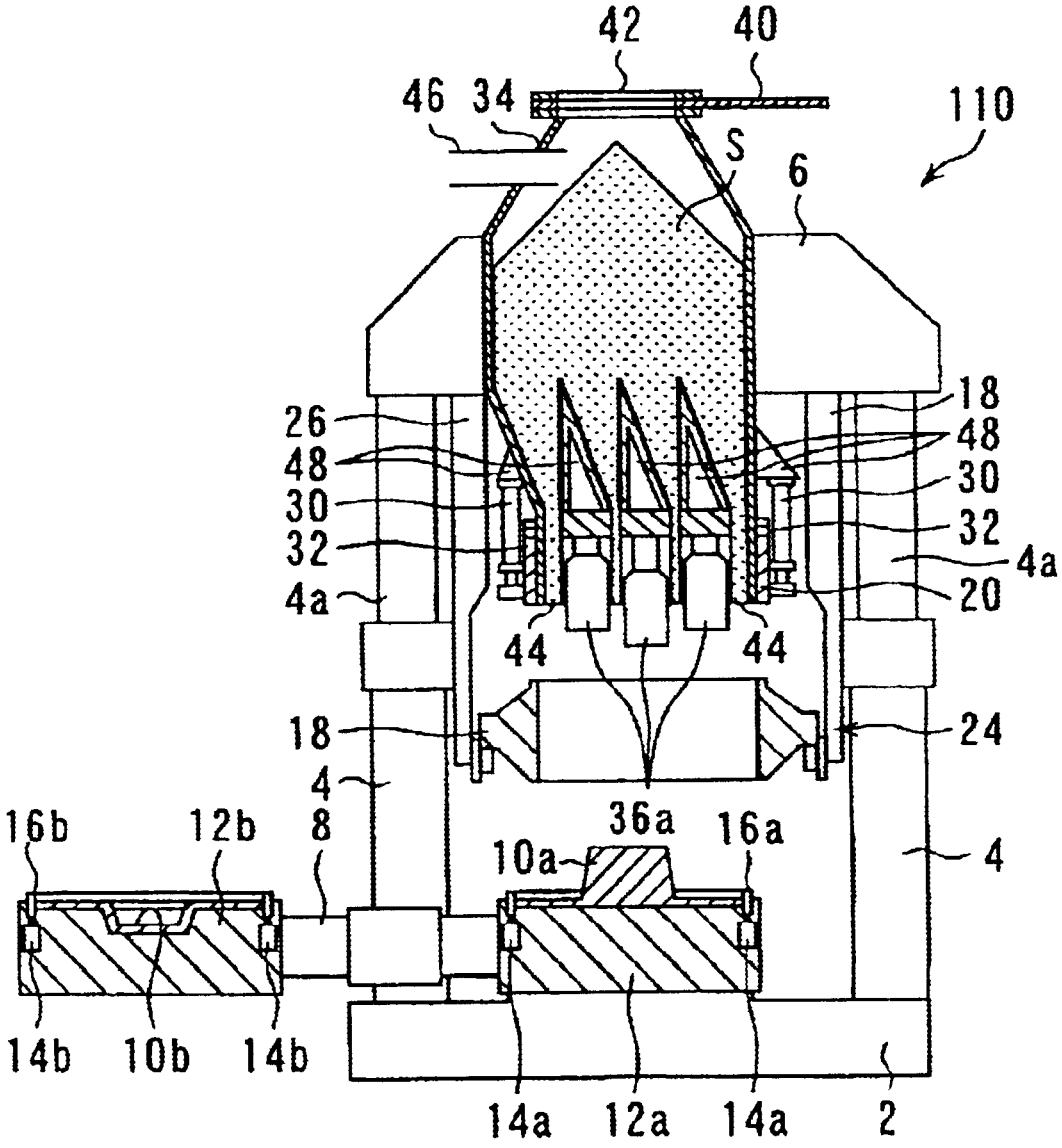
FIG. 9 shows a sectional view similar to FIG. 8, but the step where the molding sand is filled by aeration.

The first airflow of compressed air (for introducing the molding sand) is introduced into the sand container 34*a* through the valve (not shown) and the pipe 46 so that the molding sand S is introduced into the mold space through the nozzles 44. Simultaneously, the chambers 48 are supplied the second airflow of compressed air (for aerating) into the sand container 34*a* of the sand hopper 34 to aerate the molding sand S therein. Therefore, while the molding sand S is aerated, it is introduced into the mold space (such an introduction is herein called "aeration filling") (FIG. 9). The compressed air used in this aeration filling is discharged from the vent holes 32 of the filling frame 20 or the vent holes (described above, but not shown) of the pattern plate 1*a*, or both. In this state, the discharge control chambers (described above, but not shown) may control the amount of the air discharged from the vent holes 32. Then, the density of the introduced molding sand S in any area that has a complicated pattern on the pattern plate 1*a* in the mold space may be adjusted.

Figure 10:
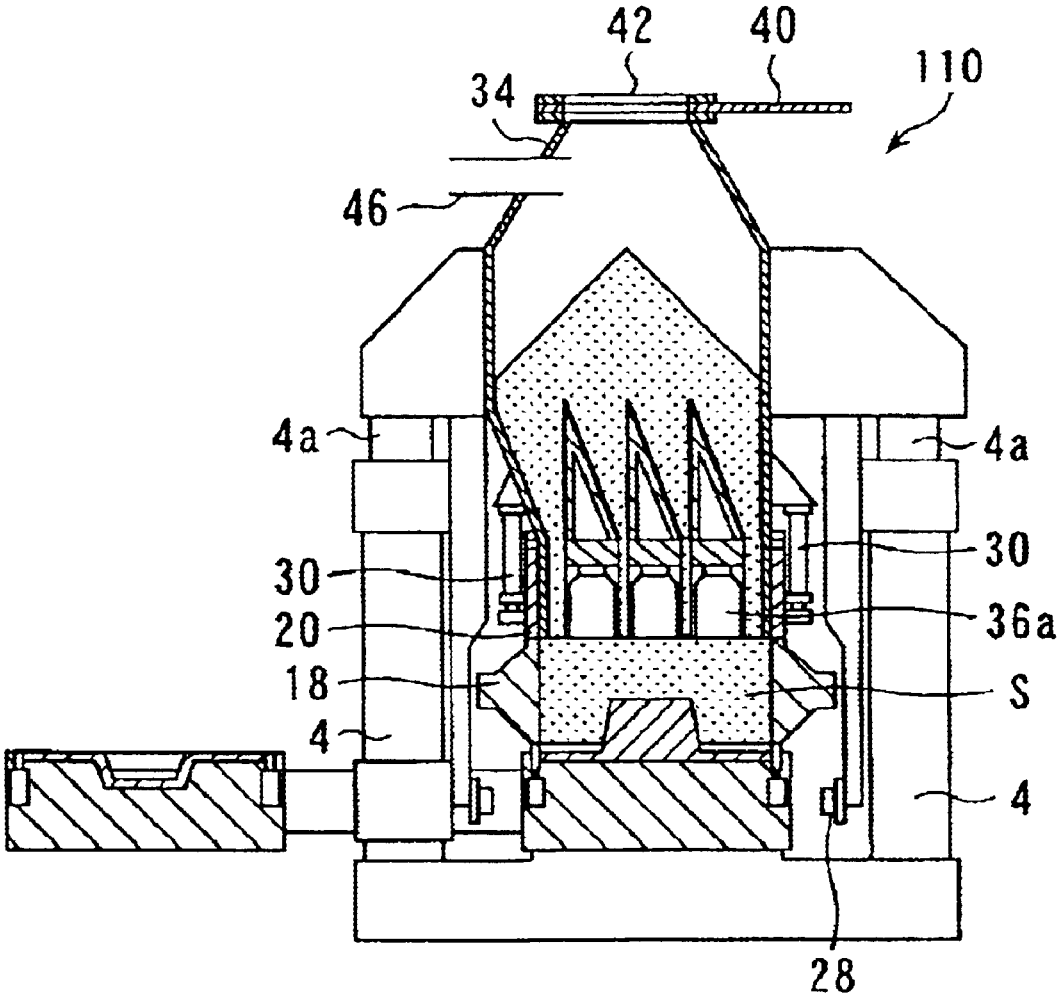
FIG. 10 shows a sectional view similar to FIG. 8, but the step where the molding sand in the mold space undergoes the first squeeze.

The main cylinders 4 are then further retracted, while the cylinders 30 of the filling frame are retracted to lower the supporting frame 6 and its supported elements mounted thereon so as to compact the molding sand S until the lower-end surface of the squeeze feet 36*a* is formed into a flat surface (the first squeeze). Simultaneously, the sliding gate 40 is inversely moved and thus the opening 42 is exposed (FIG. 10). The operation of the retraction of the main cylinders 4 in the primary squeeze is continued until the pressure of the squeeze reaches the predetermined pressure of the primary squeeze. For example, a pressure sensor (not shown) may be used to directly detect that the pressure of the squeeze reaches the predetermined pressure of the primary squeeze. Alternatively, to make an indirect detection, an encoder sensor (not shown) may be used to detect that an encoded position of the main cylinder 4 reaches the predetermined position of the primary squeeze.

Figure 11:
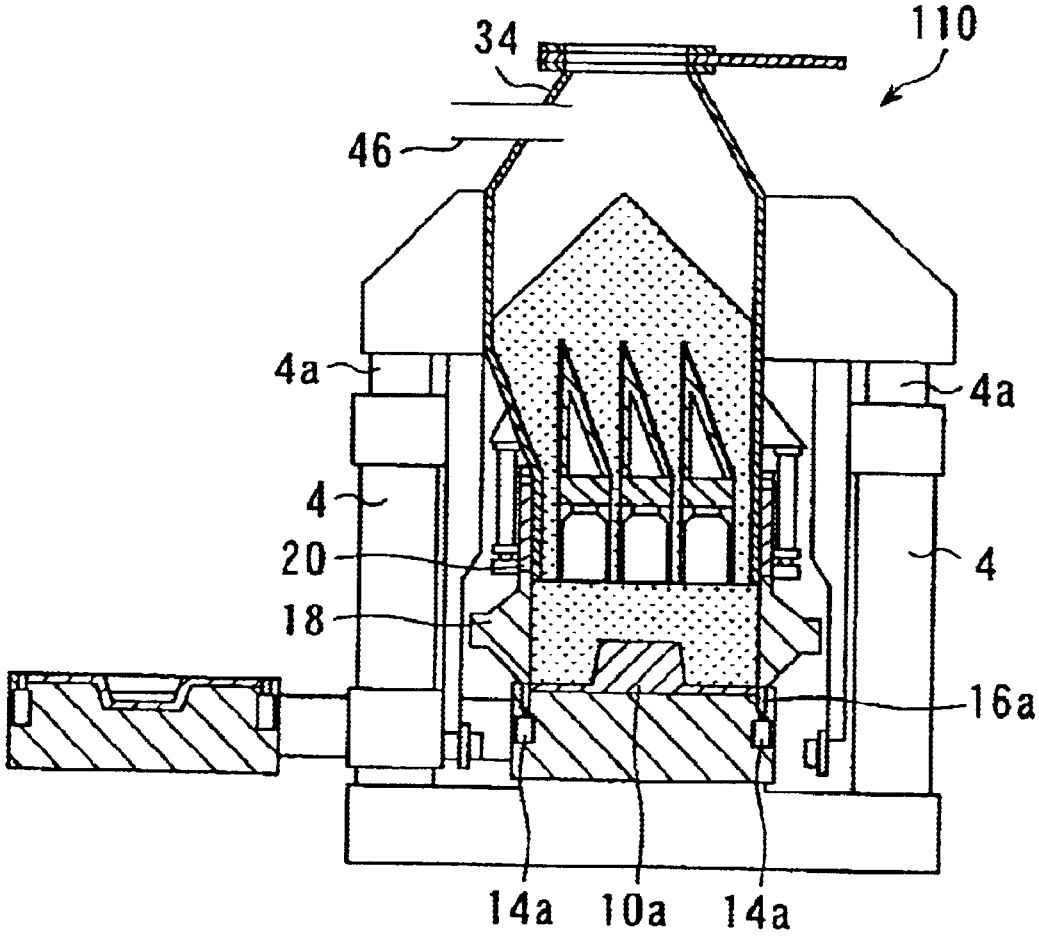
FIG. 11 shows a sectional view similar to FIG. 8, but shows the step where the molding sand in the mold space undergoes the second squeeze.

The rising cylinders 14*a* are then set so that the actuating fluid in them is released, while the main cylinders 4 are being retracted under a pressure higher than that of the primary squeeze to lower the flask 18, the filling frame 20, and the squeeze feet 36*a*, in unison, to uniformly compact the molding sand S (the secondary squeeze). At this state, the lower frame 16*a* is lowered by the retraction of the rising cylinders 14*a*, and is at substantially the same level as the top surfaces of the periphery of the pattern plate 10*a* (FIG. 11). If the pressure of the squeeze has not yet reached the predetermined pressure of the second squeeze when the leveling frame 16*a* reaches its lowest position, the cylinders 30 of the filling frame are retracted and the main cylinders 4 are further retracted to further squeeze the molding sand.

If the pressure of the squeeze reaches the predetermined pressure of the second squeeze, a timer is actuated to maintain this squeeze state for a predetermined period. At this time, the cylinders 30 are extended to lower the filling frame 20 so as to lower the flask 18 until the lower frame 16*a* reaches its lowest position. This action is in consideration of the case wherein the pressure of the squeeze may not have reached the predetermined pressure of the second squeeze when the leveling frame 16*a* reaches its lowest position. Therefore, the level of the bottom surface can be substantially matched with that of the sand mold, in every cycle.

A step for removing the flask 18, which is used to mold the sand mold as described above, is now explained. The cylinders 4 are in their retracted positions when the second squeeze has been completed. The rising cylinders 14*a* are also in their retracted positions. The main rising cylinders 4 are then lifted at a low velocity, while the rising cylinders 14*a* are lifted at a velocity that is not lower than that of the cylinders 4. The velocity of the rising cylinders 14 can be controlled by a hydraulic circuit to which the pressure of the liquid is applied.

The power of the rising cylinders 14*a* suffices to lift the leveling frame 16 and the flask 18 with the sand mold therein so as to remove the sand mold, but is insufficient to lift the main cylinders 4. The cylinders 30 of the filling frame are restrained by the working fluid. Therefore, as the main cylinders 4 are lifted, the squeeze feet 36*a* are lifted together with the filling frame 20. Further, because the rising cylinders 14*a* are lifted at a velocity that is not lower than that of the main cylinders 4, as the cylinders 14*a* are being extended the flask 18 and the filling frame 20 are lifted, in unison, in such a manner that they are closely contacted via the lower frame 16*a*, to move away from the pattern plate 10*a*.

In the conventional method for removing a sand mold, it is removed at the extended position of the cylinders of the lower pressure head. In contrast, with this embodiment, which does not use any pressure head, at the lower position (lower head) the sand mold is removed at the fully retracted position of the piston rods 2*a* of the main cylinders 4. Thus, the cylinders 4 can have a guide stroke of a sufficient length, an intensity, and a high accuracy in removing the sand mold compared to the conventional method that uses the lower head. To further increase the accuracy, preferably each cylinder 4 has a high power and a large diameter.

Figure 12:
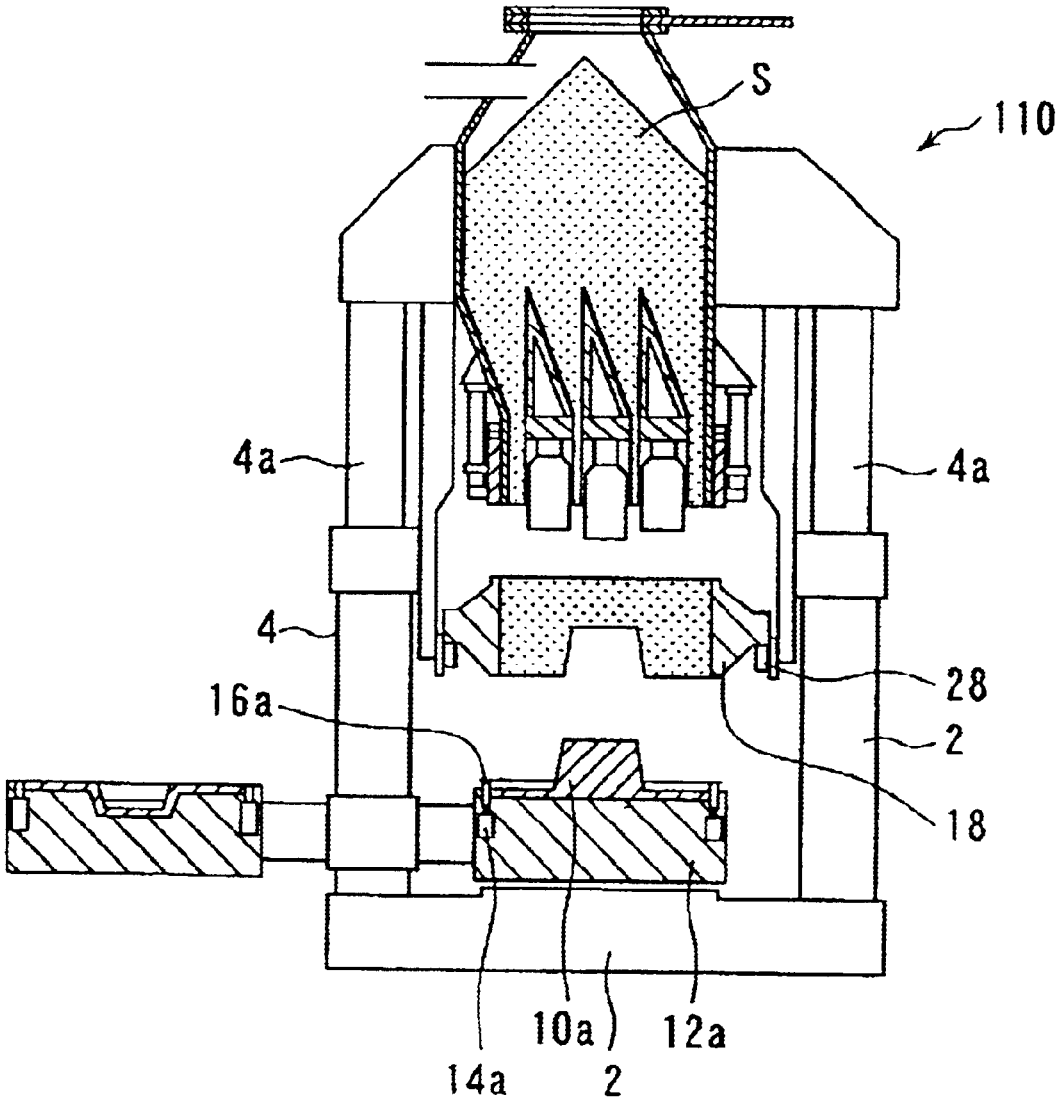
FIG. 12 shows a sectional view similar to FIG. 8, but the step where the sand mold is removed and the molding sand is supplied.

The molded sand mold is lifted a short distance with the flask 18 from the stopped position and is then separated from it. After this state, the filling frame 20 and the squeeze feet 36 are lifted in unison. In this state, the flask 18, which is used to mold the sand mold, is brought up by the conveyor 24 to be fully separated from the pattern plate 1*a*. Then new molding sand S is introduced into the sand hopper 34 (FIG. 12).

Figure 13:
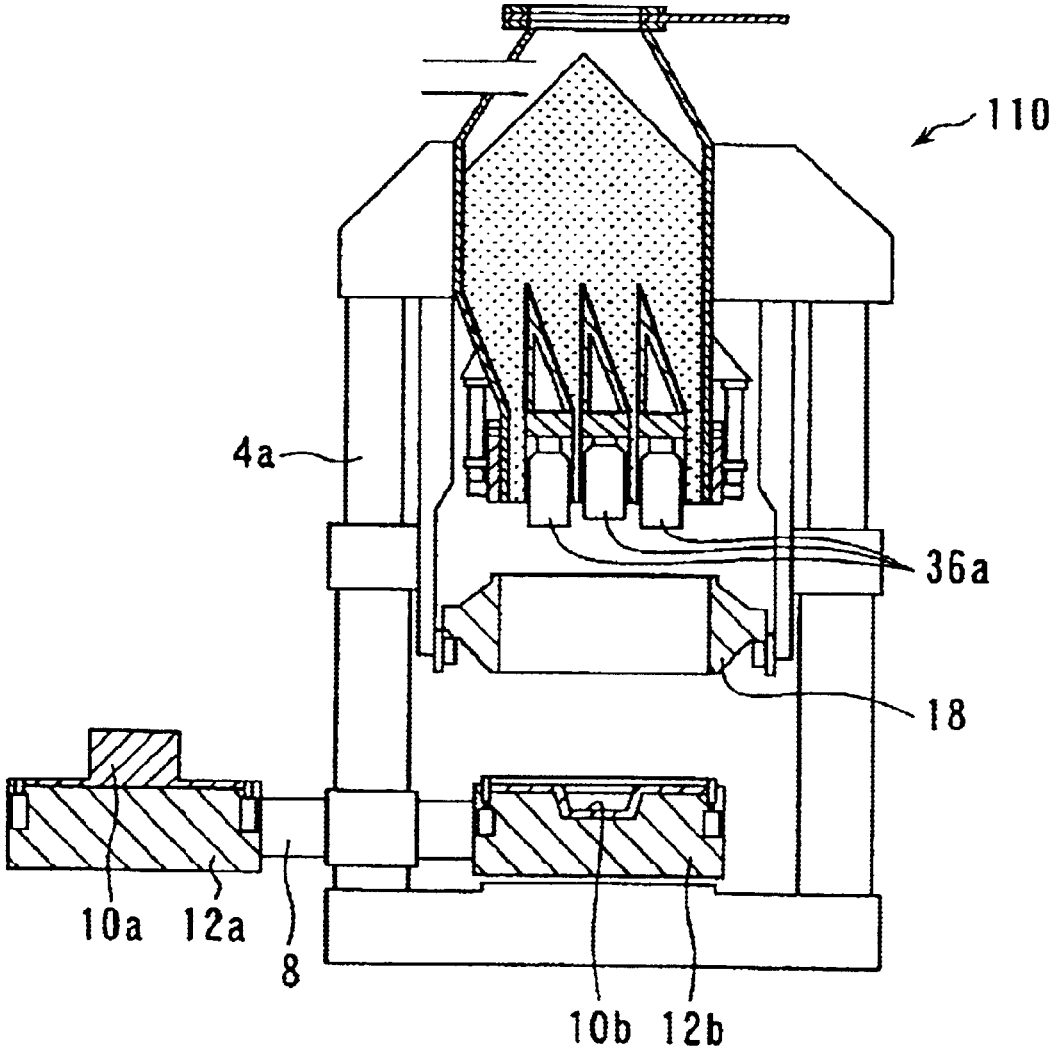
FIG. 13 shows a sectional view similar to FIG. 8, but the step where the two patterns are exchanged for each other.

The conveyor 24 is operated such that the flask 18, which is used to mold the sand mold, is moved off the machine 110, while a new, empty flask 18 is moved onto it. In this state, the turntable 8 is rotated 180 degrees so as to replace the pattern plate 10*a* with the pattern plate 10*b*. Further, squeeze feet 36*a* are actuated so that the squeeze surface that is formed by all of the squeeze feet 36*a* has a convex-and-concave profile that matches the convex and concave profile of the pattern plate 10*b* (FIG. 13). Then the process described above is repeated for the pattern plate 10*b*.

This embodiment performs no pre-squeeze. As needed, however, a design for performing the pre-squeeze may be employed. For example, an alternative sand hopper whose lower end is further provided with a rotation gate and an inlet for compressed air can be used to pre-squeeze the molding sand S by means of a flow of the compressed air.

In this embodiment, the lower frame 16*a* or 16*b*, which encloses the periphery of the corresponding pattern plate 10*a* or 10*b* such that it can be vertically and slidably moved, is supported by the upwardly-facing cylinder 14*a* or 14*b*, which is embedded in the pattern carrier 12*a* or 12*b* at the peripheries of the four corners of the pattern plate 10*a* or 10*b*. Alternatively, pattern carriers 12*a* and 12*b* (shown in FIG. 14) may be employed (only one pattern carrier 12*a* is shown in FIG. 14).

Figure 14:
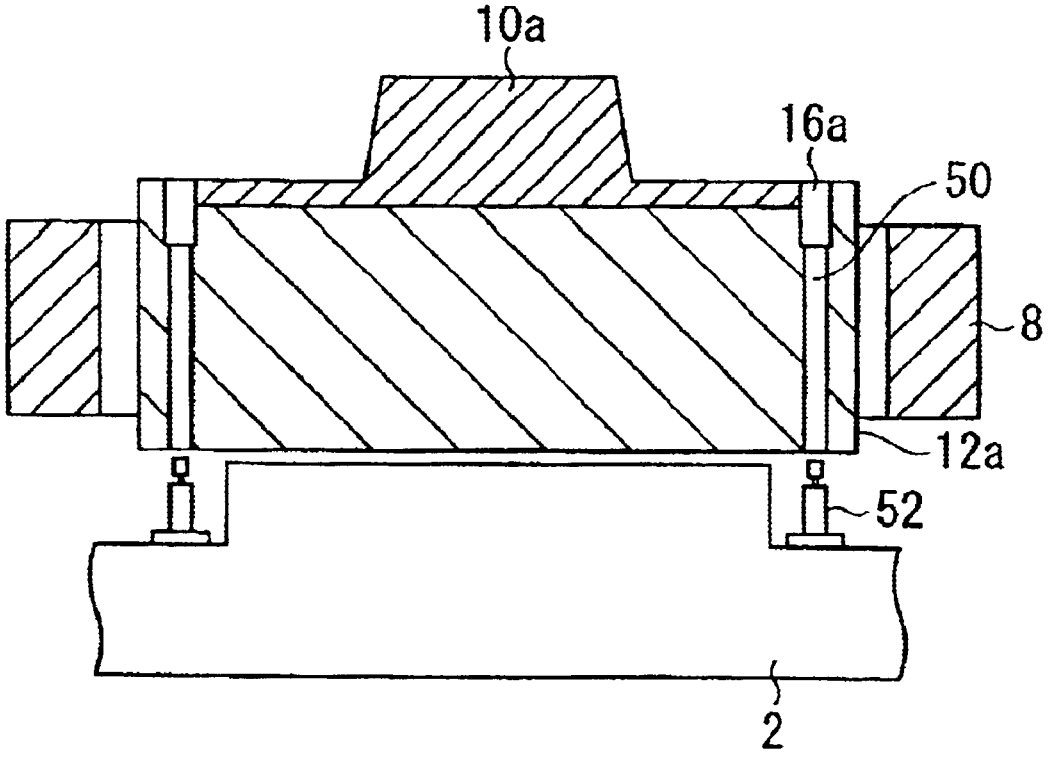
FIG. 14 is a schematic, elevational, and sectional view of another pattern carrier.

In FIG. 14, pins 50 for pushing the lower surface of the leveling frame 16 so as to maintain its horizontal position are inserted through the pattern carrier 12*a*. Upwardly-facing cylinders 52, which are similar to the rising cylinders 14*a*, are embedded in the base 2 at the peripheries of the four corners, which correspond to four pins 50, of the base 2 for vertically moving the pins 50. Therefore, the cylinders 52 support the leveling frame 16*a* via the pins 50 through the pattern carrier 12*a*.

The distal ends of the cylinders 52 cannot reach the lower surface of the pattern carrier 12*a* at their fully retracted position. The cylinders 52 also serve as the cylinders 14*a* and 14*b* for the upper and lower pattern carriers on the respective ends of the pattern changer 8. Because the four cylinders 52 may be arranged on the base 2 so that no cylinders 14*a* and 14*b* need to be located on the pattern carriers, the construction of the pattern carriers may be simplified.

Because the number of cylinders for moving the pattern plates may be reduced, if the cylinders 52 are hydraulic cylinders the hydraulic circuit for them may be simplified and thus the maintenance for them may be readily done.

Even with such a modification, the high accuracy of removing the sand mold is still obtained, since the sand mold is removed at the fully retracted position of the piston rods 4*a* of the main cylinders 4.

Of course, the pattern changer 8 is being moved, and does not interfere with the cylinders 52.

Preferably, the pins 50 are provided with some means for preventing them from the falling out. For example, clamps for clamping the pins 50 to the leveling frame 16*a* may be positioned.

The pattern carrier 12*a* may be provided with a first clamp (not shown) to tightly clamp it to the base 2, while the base 2 may be provided with a second clamp (not shown) to stretch and clamp the first clamp so as to tightly clamp the pattern carrier 12*a* to the base 2.

Figure 15:
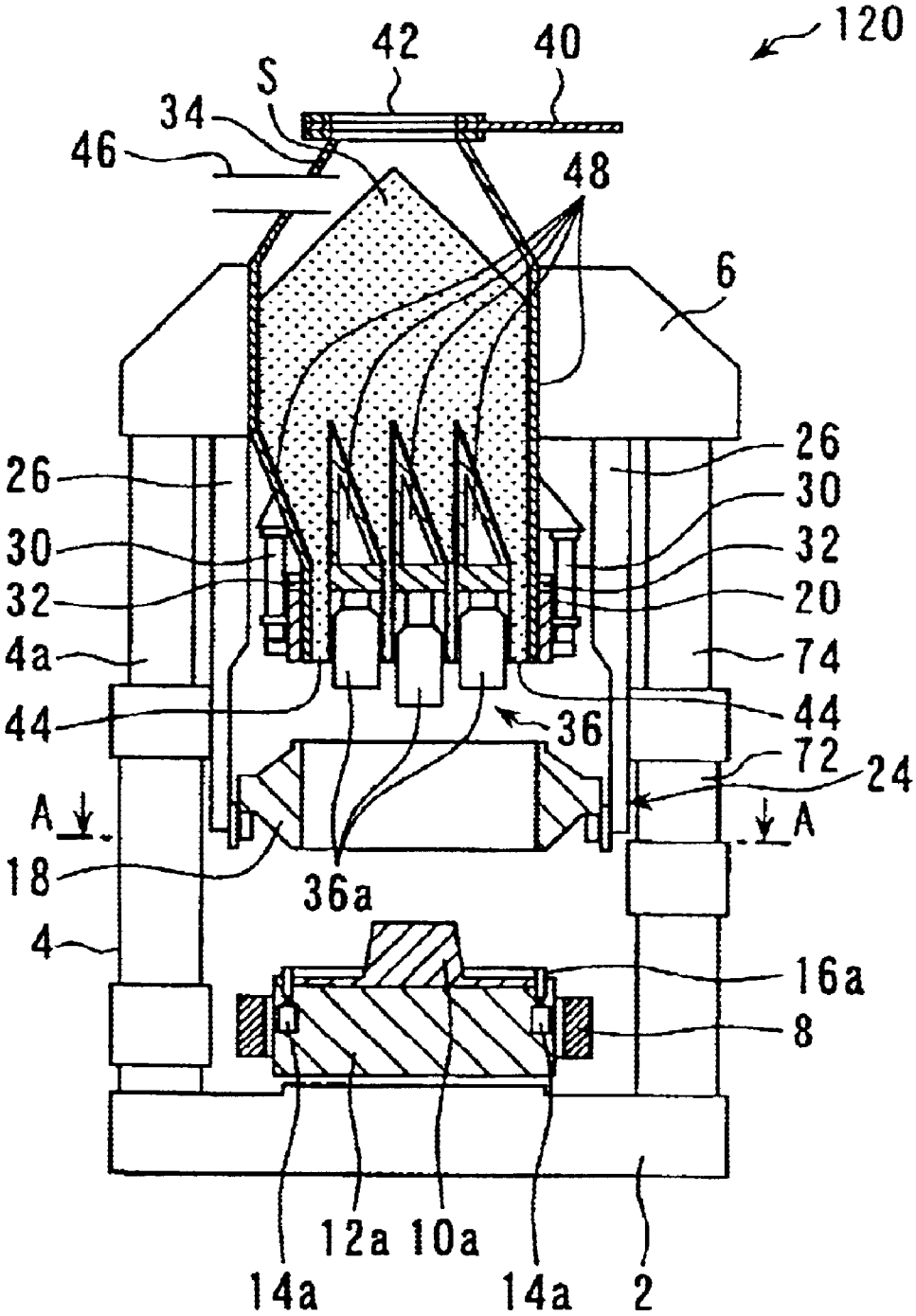
FIG. 15 is a schematic, elevational, and sectional view of the apparatus of the third embodiment of the present invention.
Figure 16:
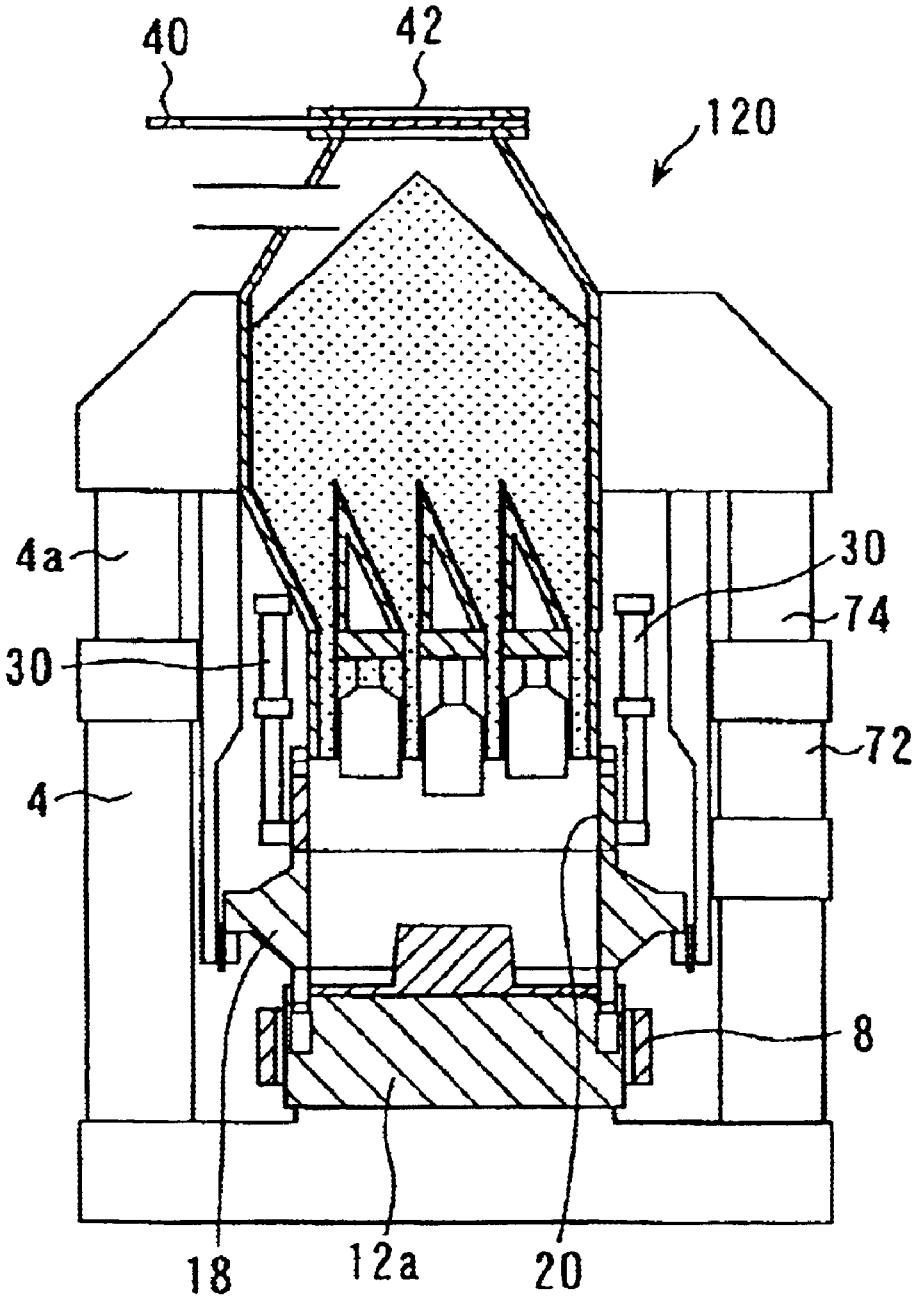
FIG. 16 is schematic, elevational and sectional view of the apparatus of FIG. 15 to explain the operation of it, where a mold space to mold a sand mold is defined.
Figure 17:
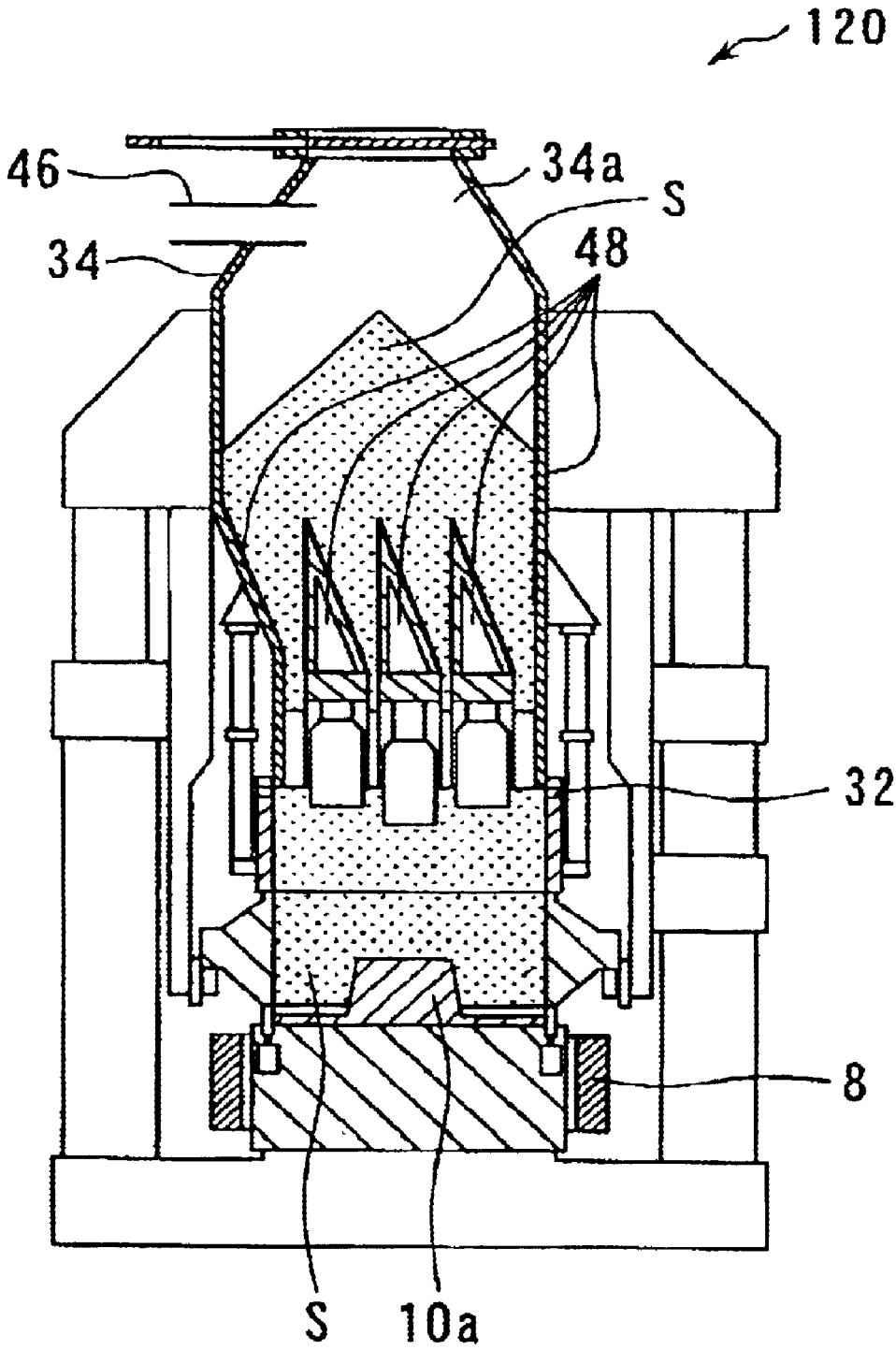
FIG. 17 shows a sectional view similar to FIG. 16, but the step where the molding sand is filled by aeration.
Figure 18:
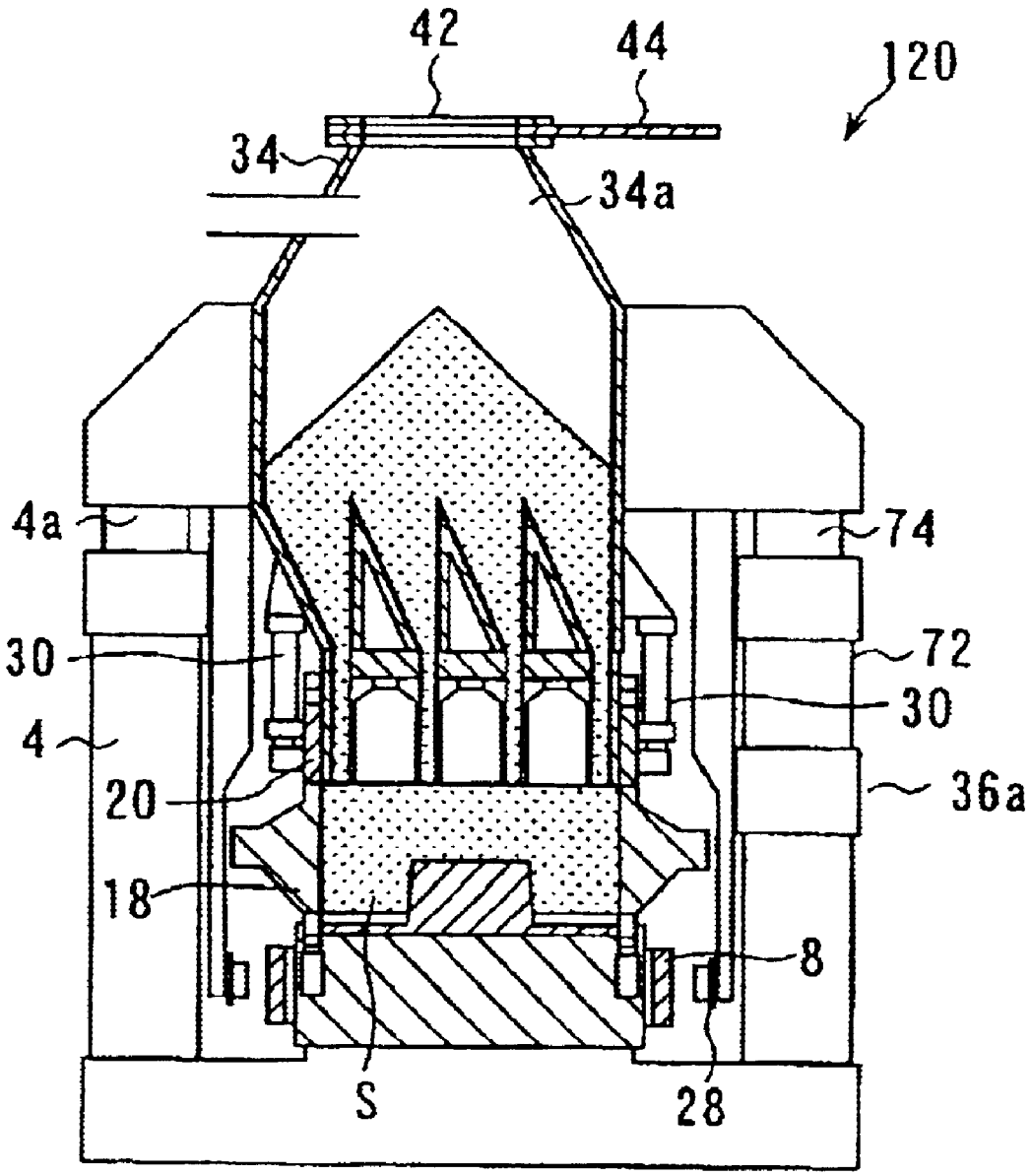
FIG. 18 shows a sectional view similar to FIG. 16, but the step where the molding sand in the mold space undergoes the first squeeze.
Figure 19:
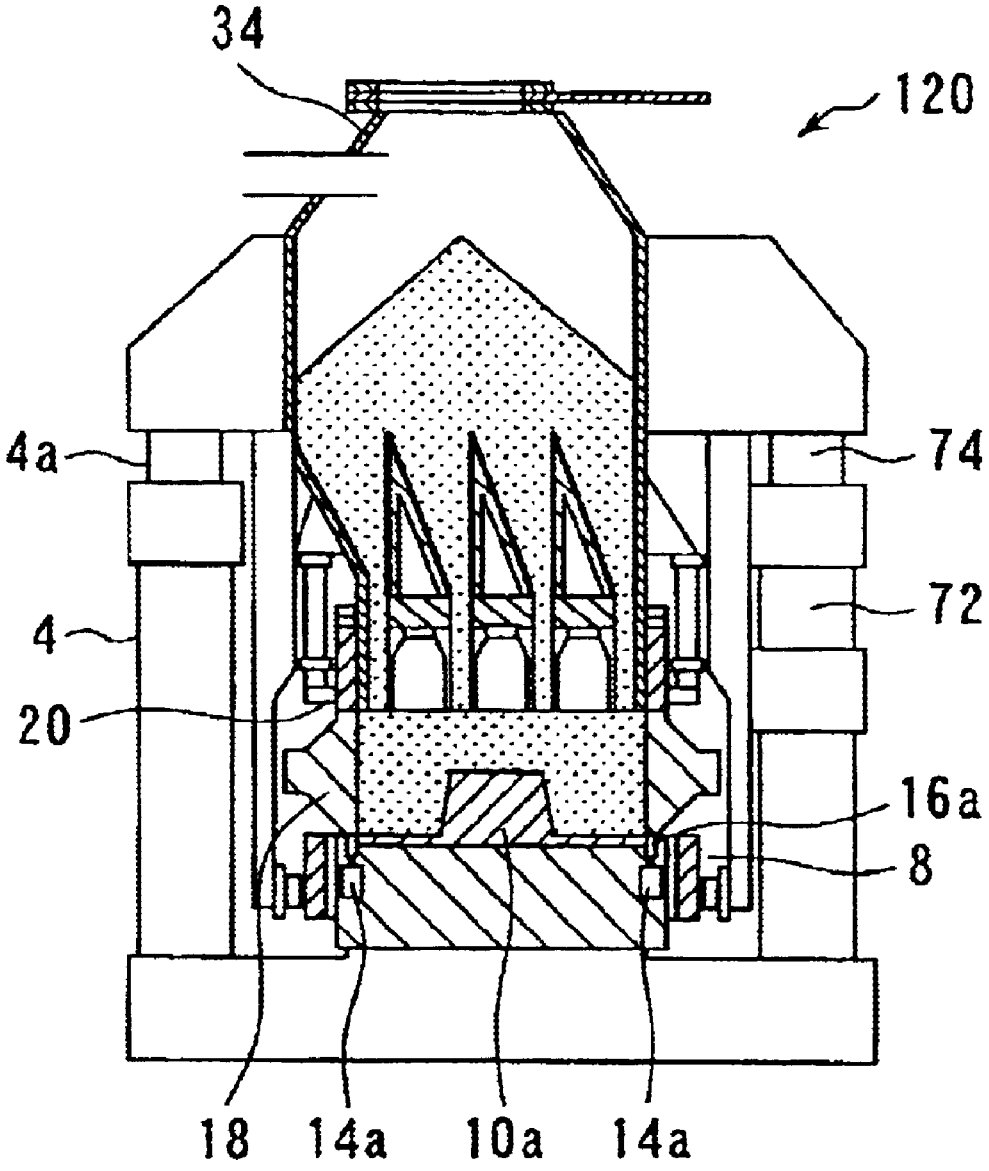
FIG. 19 shows a sectional view similar to FIG. 16, but the step where the molding sand in the mold space undergoes the first squeeze.
Figure 20:
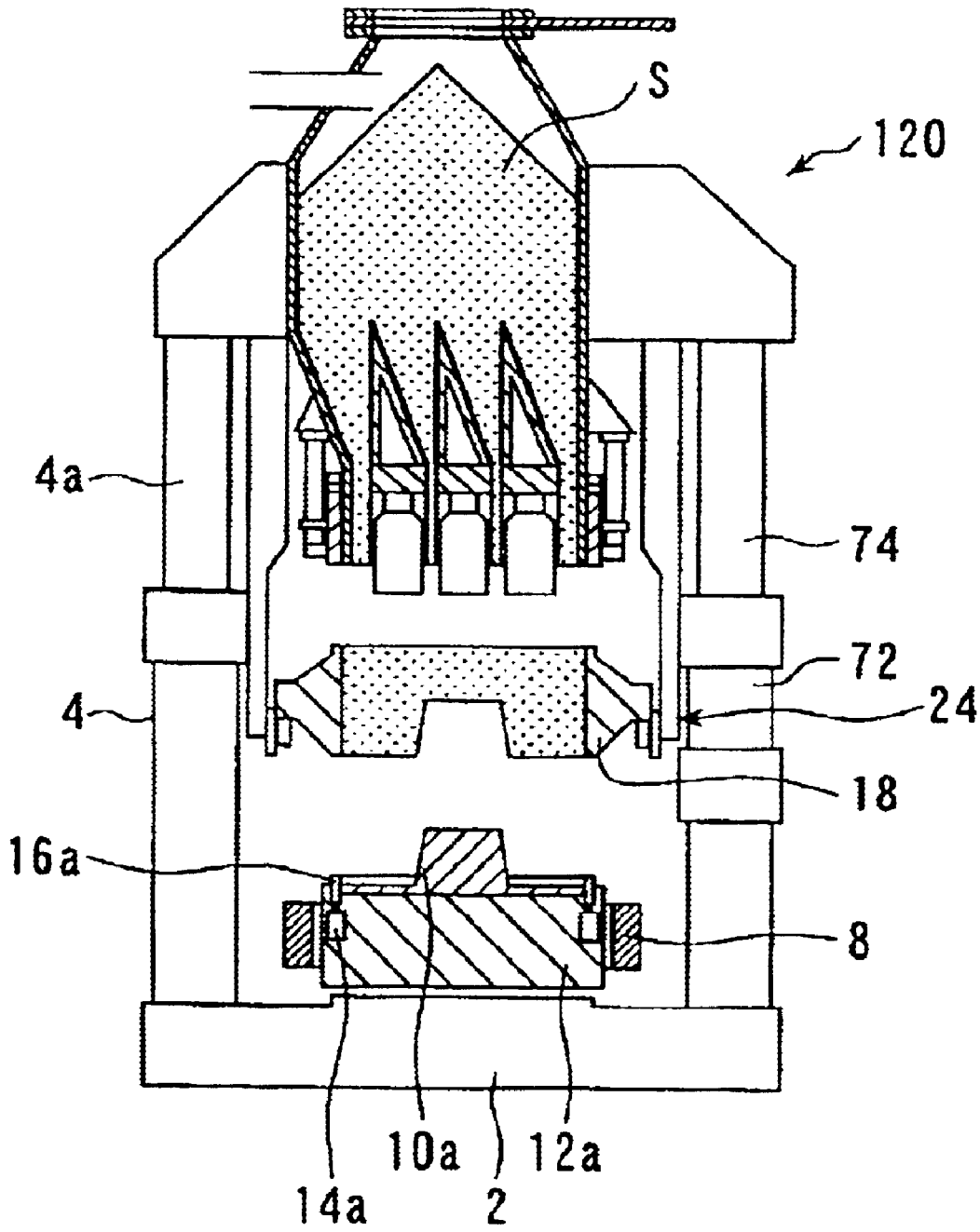
FIG. 20 shows a sectional view similar to FIG. 16, but the step where the sand mold is removed and the molding sand is supplied.
Figure 21:
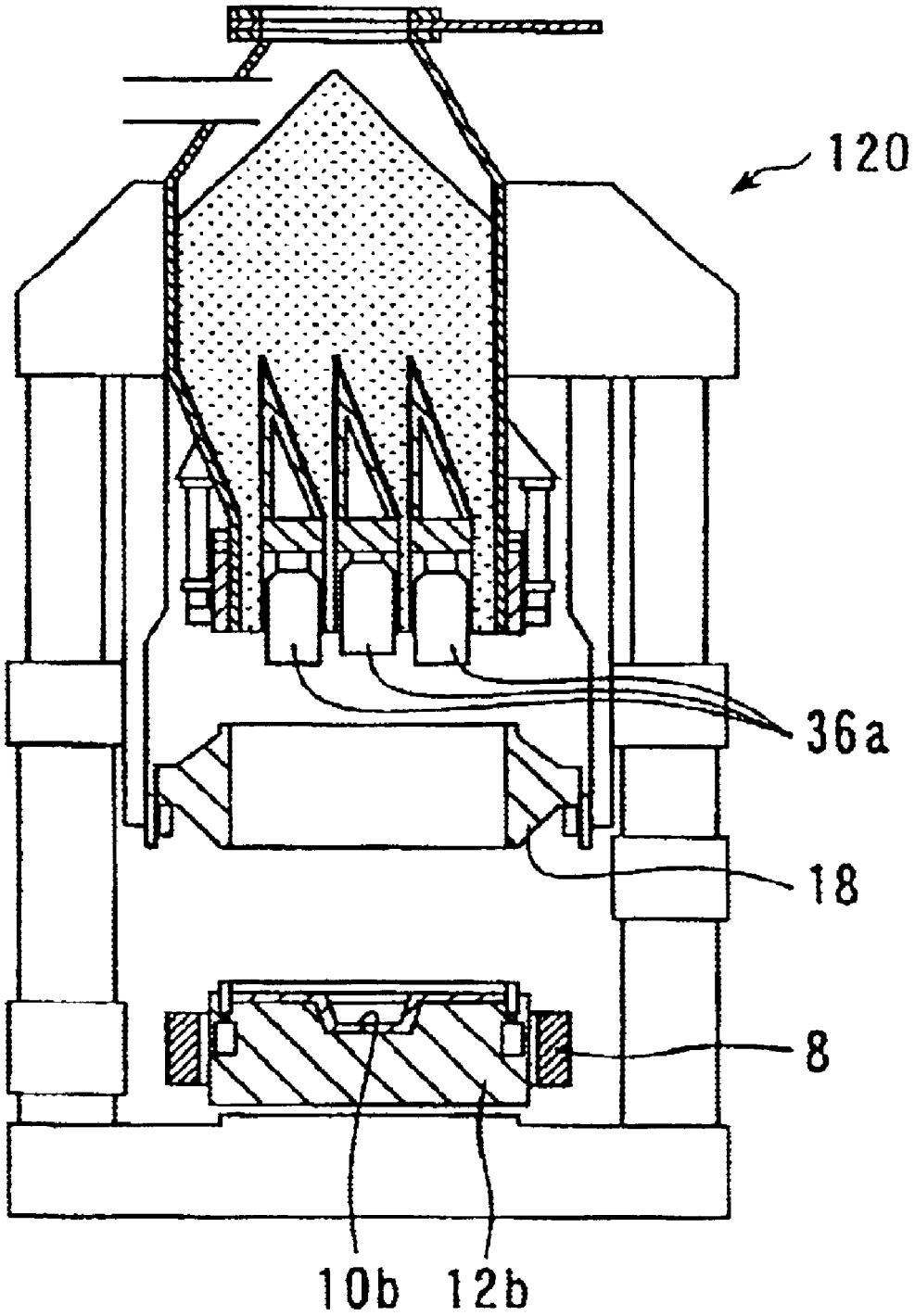
FIG. 21 shows a sectional view similar to FIG. 16, but the step where the two patterns are exchanged for each other.

In reference to FIGS. 15–22, the third embodiment of the invention is now explained. In FIG. 15, a molding machine, generally denoted by the number 120, employs the multi-segmented squeeze feet 36*a* as the squeezing element 36. The nozzles 44 are arranged at the peripheries of the squeeze feet 36*a*.

Figure 22:
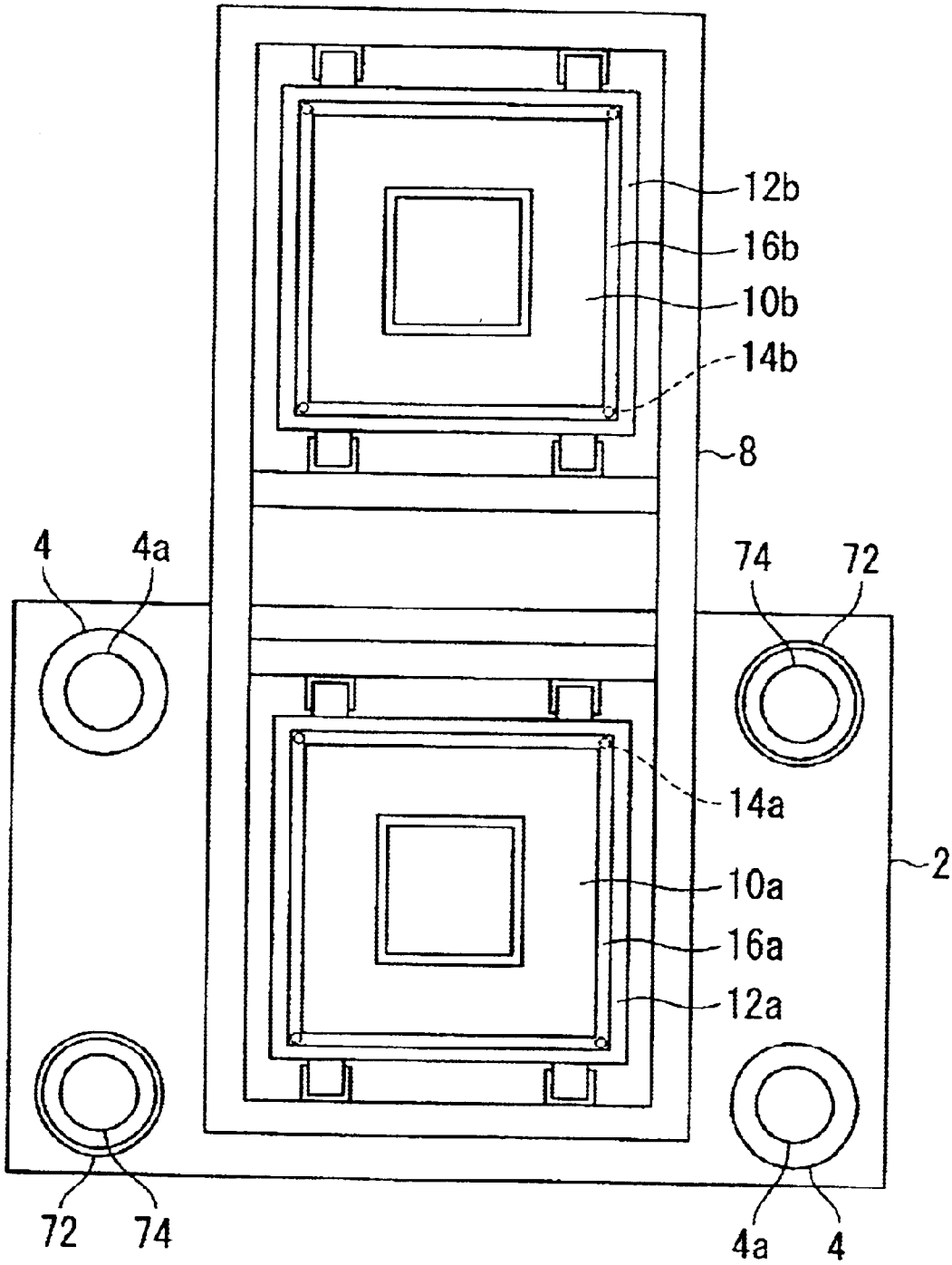
FIG. 22 shows an elongated view taken along the arrows A—A of FIG. 15.

In reference to FIG. 22, which shows a cross-sectional view of FIG. 15, two main cylinders 4, each of which is similar to that of the first or second embodiment, and two guide holders 72, which slidably receive guide pins 74 therein, are arranged on a base 22 having a square-like cross section. When viewed from above the base 22, the main cylinders 4, which are similar to those of the first or second embodiment, are arranged on the upper-left corner and the lower-right corner, which are opposite each other on one diagonal line of the base. Further, the guide holders 72, which receive the guide pins 74, are arranged on the upper-right and the lower-left corners, which are opposite each other on another diagonal line of the base. Therefore, in the third embodiment, the supporting frame 6 is secured to the distal ends of the piston rods 4*a* of the main cylinders 4 and the guide pins 74.

The pattern changer 8 of the machine 120 is a linear reciprocating table instead of the turntable of the first or second embodiment. The linear reciprocating table 8 moves reciprocally (the vertical direction in the drawing of FIG. 17) in a direction that extends forward and backward of the base 2 by means of an actuator (not shown).

On the two sides of the pattern changer 8, pattern carriers 12*a* and 12*b* support the pattern plates 10*a* and 10*b* in a manner that is the same as that of the first and second embodiment. The linear motion of the pattern changer 8 can alternatively change the pattern plates 10*a* and 10*b* in such a way that one is moved to the center area on the base 2, the other being removed from it (FIG. 22).

Another construction of the machine 120 is similar to that of the second embodiment. Similar to the second embodiment, the machine 120 can make initial settings (FIG. 15), tightly clamp the pattern carrier 12*a* to the base 2 (FIG. 16), make the aeration introduction (FIG. 17), make the primary squeeze (FIG. 18), make the second squeeze (FIG. 19), remove the sand mold (FIG. 20), replace the pattern plates 10*a* and 10*b* with each other (FIG. 21), and repeat these steps. In these steps, however, the guide pins 74 are vertically moved as the main cylinders 4 are retracted and extended. The linear motion of the pattern changer 8 replaces the pattern plates 10*a* and 10*b*.

Similar to the second embodiment, the sand mold that is molded in the third embodiment is lifted a short distance, with the flask 18, from the stopped position and is removed at a lower velocity and at the fully retracted position of the main cylinders 4 so that the removing of the sand mold is highly accurate. Because the power of each main cylinder 4 can be reduced, the diameter of each cylinder may be decreased or the diameter of the corresponding piston rod 4*a* can be increased. Therefore, the main cylinders 4 may be adapted to a limited space that is available for installing them. To replace the pair of pattern plates 10*a*, 10*b* with another pair, a suitable device (not shown) for conveying the pattern plates removes the pattern carriers 12*a*, 12*b*, with the pattern plates 10*a*, 10*b* thereon, from the pattern changer 8. Then an operator replaces the pair of pattern plates 10*a*, 10*b* with a new pair. The device then moves the pattern carriers 12*a*, 12*b*, with the new pair of pattern plates thereon, into the pattern changer 8.

Figure 23:
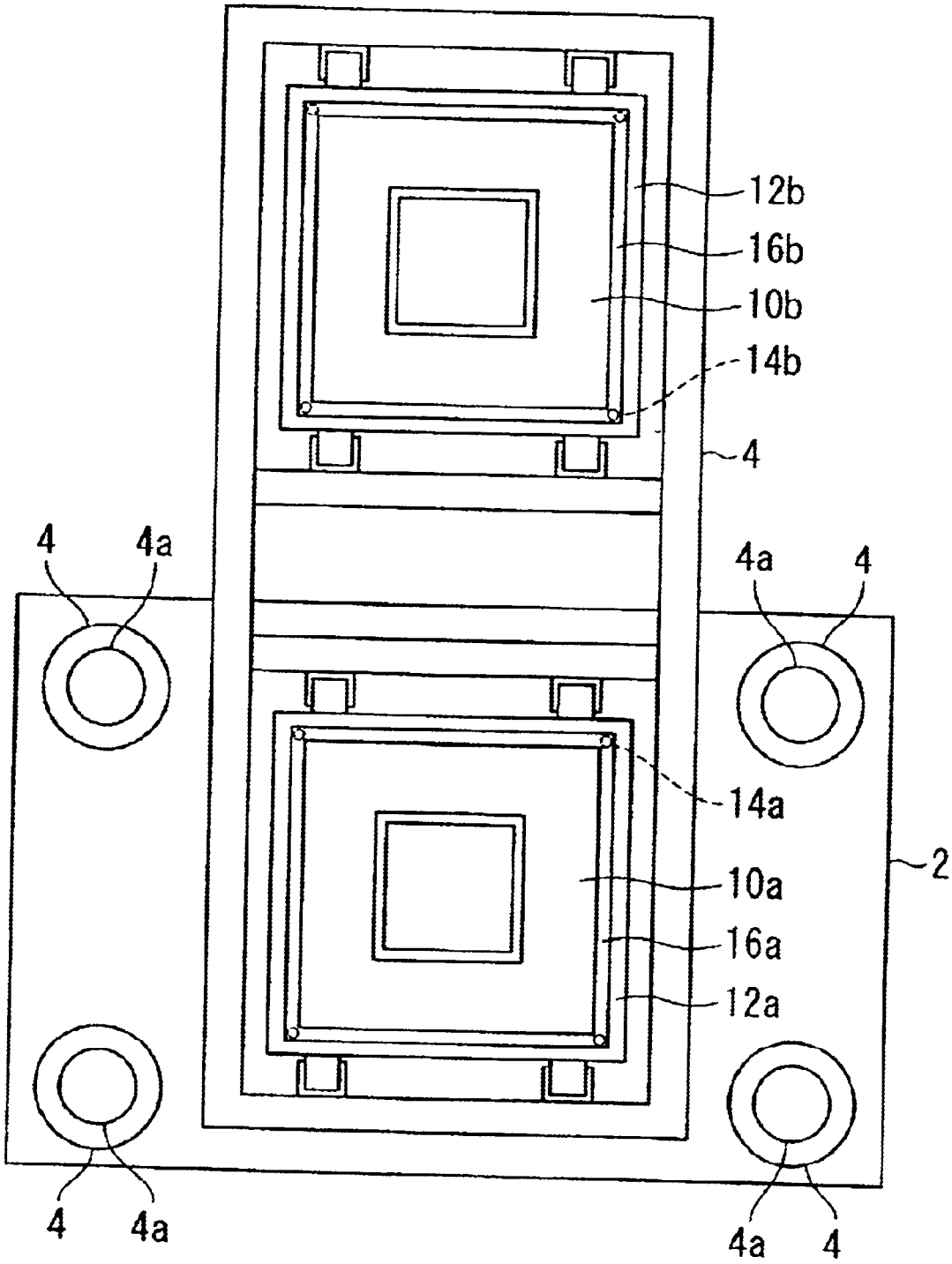
FIG. 23 shows a cross-sectional view of one modification of the apparatus of the third embodiment, where four cylinders are arranged to form a square.

Now, modifications of the third embodiment are explained. As noted above, in FIGS. 15 to 23, the pair of the main cylinders 4 and the pair of the guide pins 74 are arranged on one pair of the corners on one diagonal line and on another pair of the corners on another diagonal line of the base 2, respectively. Alternatively, as shown in a cross-sectional view of FIG. 23, the four main cylinders 4 may be arranged on all four corners on the two diagonal lines of the base 2 so that the guide pins 74 may be omitted.

Figure 24:
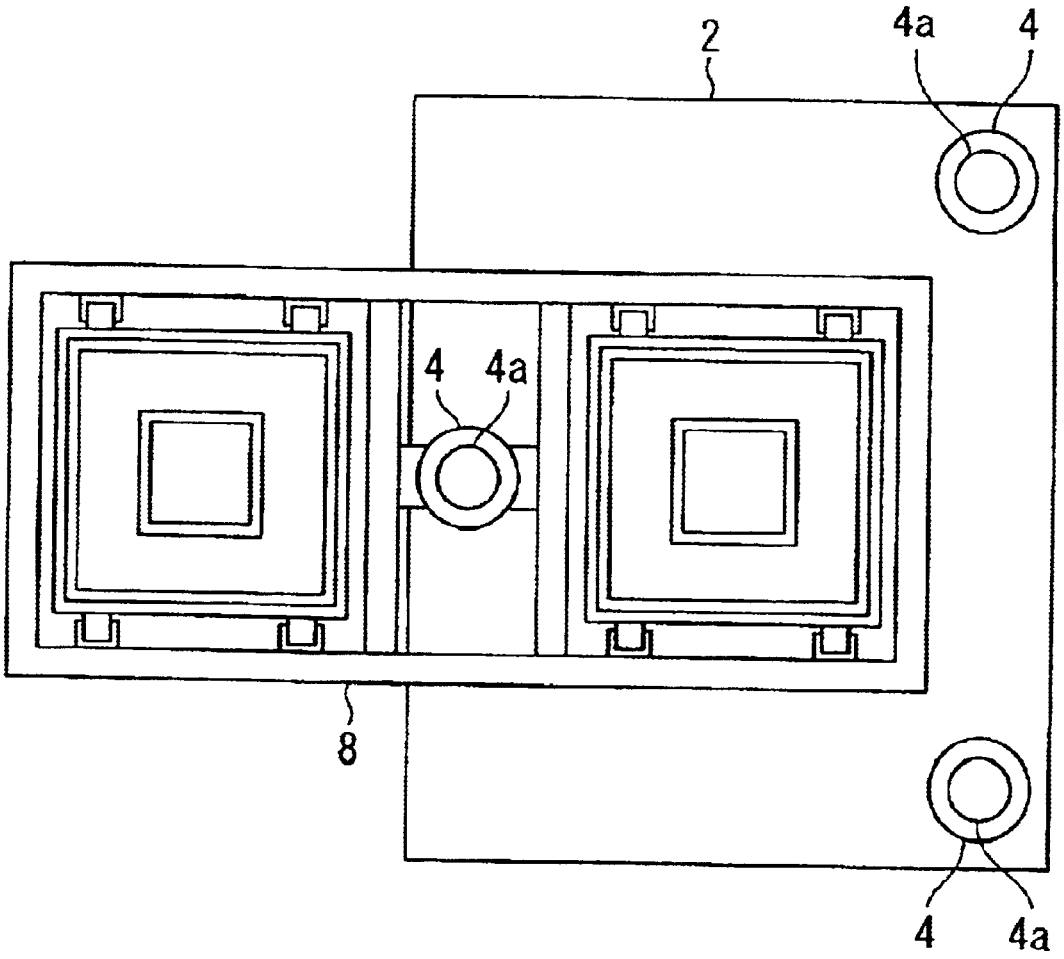
FIG. 24 shows a cross-sectional view of another modification of the apparatus of the third embodiment, where three cylinders are arranged to form a triangle.

In another alternative, as shown in a cross-sectional view of FIG. 24, three main cylinders 4 may be arranged so as to form a triangle where one of them is located on the left side of the base, and two of them are located on the right side of the base. In this case, the linear motion type of pattern changer 8 may be replaced with a turntable whose axis of rotation is the left cylinder 4.

In the third embodiment and its modifications, the supply of the second compressed airflows and the pressure may be adjusted in the same ways as those of the second embodiment.

In the third embodiment and its modifications, the rising cylinders 14*a* and 14*b* are embedded in the pattern carriers 12*a* and 12*b* for vertically and slidably moving the lower frames 16*a* and 16*b*. Alternatively, elements similar to the rising cylinders 14*a* and 14*b* may be embedded in the pattern changer 8. This design may be embodied as in the design of FIG. 14 in the second embodiment.

Figure 25:
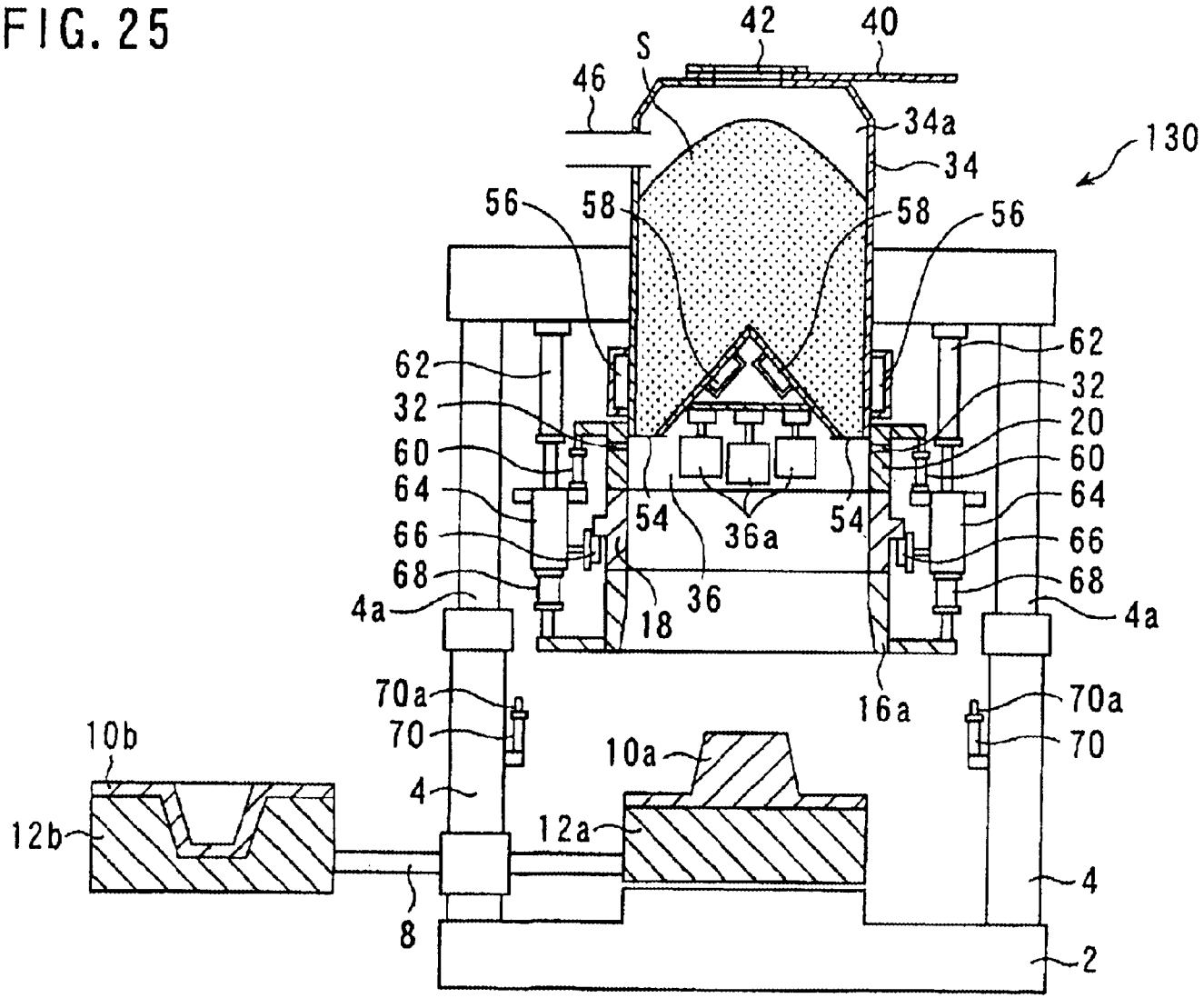
FIG. 25 is a schematic, elevational and sectional view of the apparatus of the fourth embodiment of the present invention.
Figure 26:
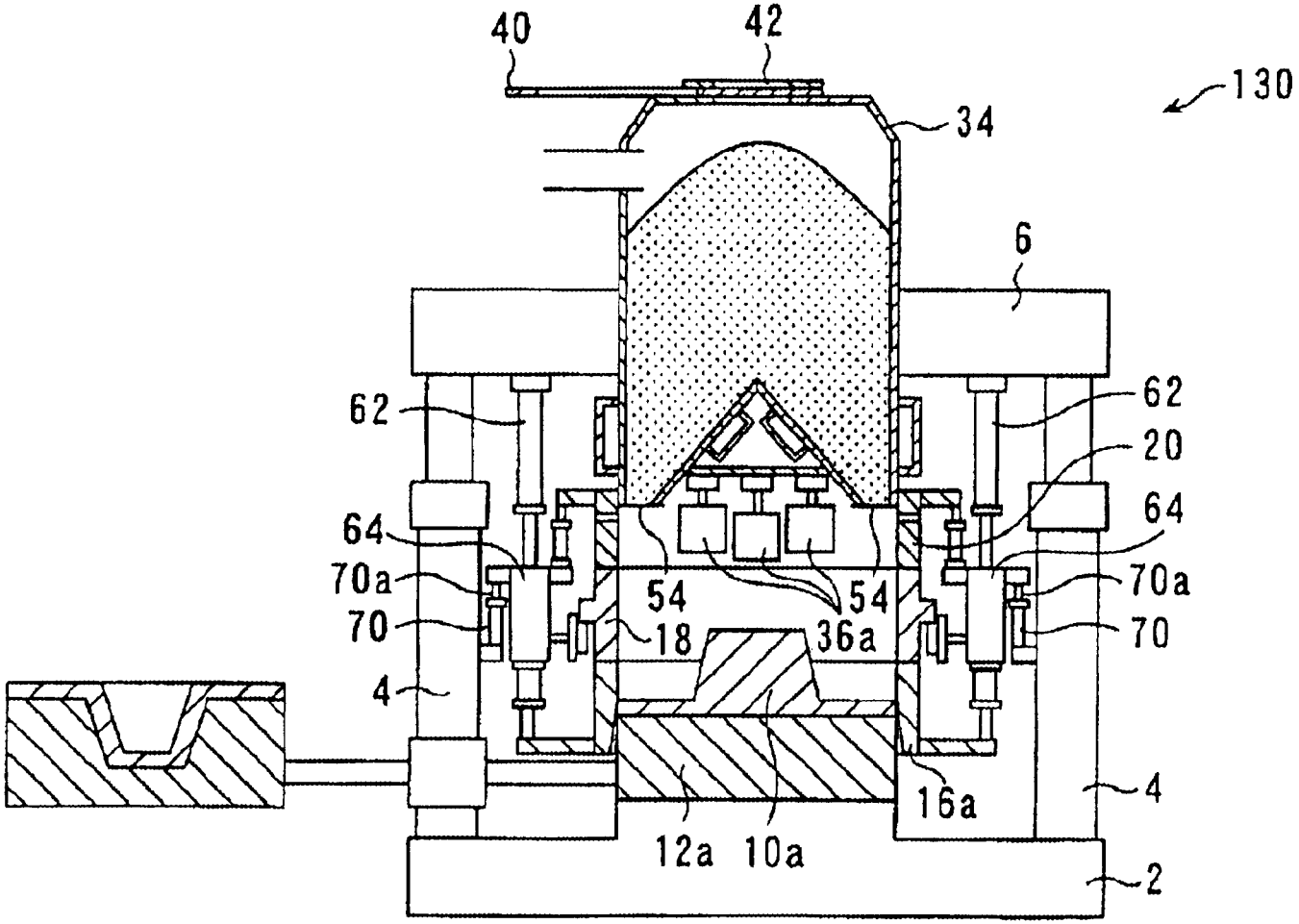
FIG. 26 is schematic, elevational and sectional view of the apparatus of FIG. 25 to explain the operation of it, where a mold space to mold a sand mold is defined.

FIGS. 25 and 26 show the fourth embodiment of the invention. A molding machine, generally denoted by the number 130, employs multi-segmented squeeze feet 36*a* as the squeezing element 36. A plurality of nozzles 54 for discharging molding sand is arranged at the peripheries of the squeeze feet 36*a*. The way that the filling frame 20 in the machine is supported will be described below.

The pattern carriers 12*a*, 12*b* and the base 2 are provided with a first clamp and a second clamp (neither shown), respectively. The second clamp is stretched and clamps the first clamp so as to tightly clamp the pattern carriers 12*a*, 12*b* to the base.

A pipe 46, for introducing compressed air, is connected to the upper periphery of the sand container 34*a* of the sand hopper 34. The pipe 46 introduces a first airflow of compressed air at a relatively low pressure. It is introduced into the sand container 34*a* via a valve (not shown) from a source of compressed air (not shown) such that the molding sand S contained in the sand container 34*a* is introduced into the mold space through the nozzles 54.

The lower peripheral portions and the lower inner portions of the sand hopper 34 are provided with a plurality of first air chambers 56 and a plurality of second air chambers 58, respectively. The first and second air chambers 56 and 58 are supplied second airflows of compressed air at a relatively low pressure into the sand hopper 34 so as to float or fluidize the molding sand (this floating or fluidizing of the molding sand is herein called "aeration"). The first and second chambers 56 and 58 communicate with a source of compressed air (not shown) via a common valve (not shown). Instead of the one common valve, the first and second chambers 56 and 58 may communicate with the source of compressed air via separate valves so as to separately control the pressure of the flows of the second airflow of compressed air from the first chambers 56 and the second chambers 58.

Preferably, the pressure of both the first airflow of compressed air, from the pipe 46, and the second airflow of compressed air, from the first and second air chambers 56 and 58, are 0.05 to 0.18 MPa.

Now the manner for supporting the flask 18 and the filling frame 20 in the machine 130 is described. The filling frame 20 that surrounds the squeeze feet 36*a* and the nozzles is connected to a pair of upwardly-extending cylinders 60, which are located adjacent the respective sides of the filling frame 20, instead of the cylinders 30 as in the preceding embodiments. Near the two sides of the pair of cylinders 60 of the filling frame 20, a pair of downwardly-facing, hydraulic cylinders 62 are provided for vertically moving a conveyor 64, which is suspended from the supporting frame 6. The lower ends of the hydraulic cylinders 62 are connected to the conveyor 64, which includes rollers 66 for the flask 18. The upper end portions of the conveyor 64 are secured to the lower ends of the upwardly-extending cylinders 60 of the filing frame 20. The lower frame 16*a* is secured to a pair of downwardly-extending cylinders 68 for moving it. The lower end portions of the conveyor 64 are secured to the cylinders 68 of the lower frame. At the inner sides of the machine 130, each main cylinder 4 is attached to a stopper cylinder 70 having a cylinder rod 70*a*. The stopper cylinders 70 may be fluid cylinders, or electric cylinders, or air cylinders.

Now the operation of the molding machine 130 is explained. In FIG. 25, the sand hopper 34 is filled with molding sand S. The profile of the squeeze surface formed by all of the squeeze feet 36*a* takes on a protruding or receding profile that matches that of the opposing, upper surface of the pattern plate 10*a*, which is located under the squeeze feet 36*a*. The conveyor 64 carries an empty flask 18. The flask 18 is sandwiched or clamped between the filling frame 20 and the rollers 66 of the conveyor 64 such that it is held. The cylinders 68 of the leveling frame are retracted at a pressure at which the flask 18 cannot be lifted, so as to push the upper surface of the lower frame 16*a* against the lower surface of the flask 18. Each stopper cylinder 70 is in its fully extended position. The pattern carrier 68 is set on the turntable 8 and is lifted by the plurality of springs (not shown) in such a manner that a gap of about 5 mm is formed between the pattern plate carrier 12*a* and the base 2.

In this state, the sliding gate 40 is actuated to close the opening 42. As described above, the second clamp of the base 2 is then stretched and clamps the first clamp of the pattern carrier 10*a* to lower it against the springs so as to tightly clamp it to the base.

The main cylinders 4 are then retracted, while the conveyor 64, by means of the cylinders 62, restricts the motion of the clamped flask 18 and the vertical movable frame 6, thereby the flask 18 being set.

Under this state, a mold space is defined by the pattern plate 10*a*, the lower frame 16*a*, the flask 18, the filling frame 20, and squeeze feet 36*a*. In this mold space, the squeeze surface that is formed by all of the squeeze feet 36*a* has a protruding or receding profile that matches that of the pattern plate 10*a*, which is located under the squeeze feet 36*a*.

The condition of the flask 18 wherein it is set is maintained until the conveyor 64 contacts the distal ends of the cylinder rods 70*a* of the stopper cylinders 70. When the conveyor 64 contacts the distal ends of the cylinder rods 70*a*, if the sand hopper 34, the squeeze feet 36, and the nozzles 54 do not reach the predetermined position, the motions of the clamped flask 18 and the vertical movable frame 6 are no longer restricted. In this state, the cylinders 62 of the conveyor 64 are retracted, while the main cylinders 4 are further retracted. These retraction strokes of the cylinders 62 and the cylinders 4 are continued until the sand hopper 34, the squeeze feet 36, and the nozzles 54 reach the predetermined position. The predetermined position takes any optimum position, as, e.g., one based on the form of the pattern plate 10*a*.

The first and second chambers 56 and 58 are supplied the second airflow of compressed air into the sand hopper 34 to fluidize ("aerate") the molding sand S therein. During the aeration of the molding sand S, the first airflow of compressed air is introduced into the sand hopper 34 through the valve (not shown) and a pipe 46 so that the molding sand S is introduced ("aeration filling") into the mold space through the nozzles 44. The compressed air used in this aeration introduction is discharged from the vent holes 32 or the vent holes (described above, but not shown) of the pattern plate 10*a*, or both. In this state, the discharge control chambers (described above, but not shown) may control the amount of the air discharged from the vent holes 32 and thus the amount of it discharged from the vent holes of the pattern plate 10*a*. Then the density of the introduced molding sand S in any area that has a complicated pattern on the pattern plate 10*a* in the mold space may be adjusted.

The main cylinders 4 are then further retracted, while the cylinders 62 of the conveyor are retracted to lower the vertically-movable frame 6 and its supported elements mounted thereon so as to compact the molding sand S until the entire squeeze surface of the squeeze feet 36*a* is formed into a flat surface (the first squeeze). Simultaneously, the sliding gate 40 is inversely moved and thus the opening 42 is exposed.

The operation of the retraction of the main cylinders 4 in the primary squeeze is continued until the pressure of the squeeze reaches its predetermined pressure. For example, a pressure sensor (not shown) may be used to directly detect the pressure of the squeeze to detect that it reaches the predetermined pressure of the primary squeeze. Alternatively, for an indirect detection, an encoder sensor (not shown) may be used to detect that an encoded position of the main cylinder 4 reaches the predetermined position of the primary squeeze.

The stopper cylinders 70 are then set so that the actuating fluid in them is released, while the cylinders 62, by means of the conveyor 64, further restrict the motions of the flask 18, whose motion has already been restricted, and the vertical movable frame 6. In this state, the main cylinders 4 are retracted under a pressure higher than that of the primary squeeze, so as to lower the squeeze feet 36*a*, the filling frame 20, the flask 18, the lower frame 16*a*, and the conveyor 64 and the associated cylinders 62 in unison, toward the pattern plate 10*a*, to uniformly compact the molding sand S (the second squeeze). At this state, the lower frame 16*a* is lowered by the retraction of the stopper cylinders 70 such that the top surface of the lower frame 16*a* is at substantially the same level as the top surfaces of the periphery of the pattern plate 10*a* (FIG. 26).

If the pressure of the squeeze has not yet reached the predetermined pressure of the second squeeze when the stopper cylinders 70 reach their lowest position, the restricted motions of the clamped flask 18 and the vertical movable frame 6 are released by the cylinders 62 of the conveyor. In this state, the cylinders 62 of the conveyor are retracted and the main cylinders 4 are further retracted to further squeeze the molding sand.

If the pressure of the squeeze reaches the predetermined pressure of the second squeeze, a timer for stabilizing the squeeze is actuated to keep this squeeze state for a predetermined period. At this time, the cylinders 62 of the conveyor are extended to lower the filling frame 20 and the conveyor 64 so as to lower the flask 18 until the stopper cylinders 70 reach their lowest position so as to adapt to the case where the stopper cylinders 70 do not reach their lowest position. Therefore, in every cycle the level of the bottom surface of the flask 18 can substantially match that of the sand mold.

The main cylinders 4 are then extended to remove the sand mold. During this time the cylinders 62, by means of the conveyor 64, restrict the motions of the clamped flask 18 and the vertical supporting frame 6. As the main cylinders 4 are lifted, the squeeze feet 36*a*, the filling frame 20, the flask 18, the conveyor 64, and associated cylinders 62 are lifted in unison. The leveling frame 16*a* is also lifted with them or separately. If it is desirable that the leveling frame 16*a* be lifted with them, the pressure to be applied to the cylinders 14*a* should be one that cannot lift the flask 18.

The flask 18, which is used to mold the sand mold, is then lifted with the squeeze feet 36*a*, the filling frame 20, the conveyor 64 and the associated cylinders 62 such that it is fully separated from the pattern plate 10*a*. Then the molding sand S is supplied into the sand hopper 34.

Because the molded sand mold is lifted a short distance with the flask 18 from its stopped position and is removed at a lower velocity and at the fully-retracted positions of the piston rods 4*a* of the main cylinders 4, the removing is highly accurate.

The cylinders 60 of the filling frame are then extended to release the clamped state of the flask 18 that is used to mold the sand mold. Further, the cylinders 68 of the leveling frame are extended to lower the leveling frame 16*a*.

After this state, the conveyor 24 is operated such that the flask 18, which is used to mold the sand mold, is moved off the machine 130, while a new, empty flask 18 is moved onto the machine 130. In this state, the turntable 8, by means of the actuator (not shown), is rotated 180 degrees so as to replace the pattern plate 10*a* with the pattern plate 10*b*. Further, the squeeze feet 36*a* are actuated so that the squeeze surface that is formed by all of the squeeze feet 36*a* has a convex and concave profile that matches that of the pattern plate 10*b*. Then the process described above is repeated for the pattern plate 10*b*.

With the above process, the amounts of the spilled sand and the ground sand can be significantly reduced, and thus the molding sand S can be efficiently supplied with a fixed quantity. Further, a squeeze that well matches the protruding or receding profile of the pattern plate can be uniformly applied to the sand mold. Thus uniform sand molds can be produced.

Although this embodiment employs the turntable 8 as the pattern changer, it may be replaced with a linear-type table that moves forward and backward of the machine.

As needed, an alternative design to perform the pre-squeeze may be employed. An alternative sand hopper, whose lower end is also provided with a rotation gate and an inlet for compressed air, can perform the pre-squeeze for the molding sand S by a flow of the compressed air.

To perform the aeration, although this embodiment employs both the first chambers 56, located at the lower peripheral portions of the sand hopper 34, and the second chambers 58, located at the lower inner portions of the sand hopper 34, just the first chambers 11 or the second chambers 12 are used.

What is claimed is:

1. A method for introducing and compacting molding sand in a mold space to mold a sand mold, wherein the mold space is defined by a horizontally fixed pattern plate having a pattern, a vertically movable lower auxiliary frame for surrounding said pattern plate, a vertically movable flask placed above said leveling frame for surrounding the pattern, a vertically movable filling frame placed above said flask, and vertically movable compacting means placed above said filling frame in such a manner that a lower portion of said compacting moans is insertable into said filling frame, said method comprising the steps of:

introducing molding sand in the mold space;

lowering said compacting means to compact the molding sand in the mold space as to carry out a primary squeeze under a condition where at least said lower auxiliary frame cannot be lowered; and further lowering said compacting means to further compact the molding sand in the mold space so as to carry out a second squeeze under a condition where said lower auxiliary frame and said flask can be lowered.

2. The method of claim 1, wherein a force of the compression applied to the molding sand by said compacting means in the second squeeze is greater than that in the primary squeeze.

3. The method of claim 1, wherein said compacting means includes a plurality of squeeze feet for compacting the molding sand, wherein each squeeze foot is independently, vertically, and separately movable.

4. The method of claim 3, further comprising the steps of:

making a protruding or receding profile of a squeeze surface that is defined by said squeeze feet when the mold space is being formed; and making a planer profile of the squeeze surface when the squeeze has been completed.

5. The method of claim 1, wherein said introducing step is carried out in such a manner that an airflow of compressed air fluidizes the molding sand to be introduced to the mold space, and an additional airflow of compressed air introduces the fluidized molding sand into the mold space.

6. A method for removing a molded sand mold from a mold space, wherein said mold space for molding a sand mold is defined by a horizontally fixed pattern plate having a pattern, a vertically movable leveling frame for surrounding said pattern plate, a vertically movable flask placed above said lower auxiliary frame for surrounding the pattern, a vertically movable filling frame placed above said flask, and compacting means that is attached to a vertically movable supporting means placed above said filling frame in such a manner that a lower portion of said compacting means is insertable into said filling frame, for a first squeezing and a second squeezing of molding sand that is introduced in the mold space so as to mold the sand mold, said method comprising the steps of:

lifting said leveling frame at a predetermined velocity so as to apply an upwardly-facing force to said supporting means via said filling frame, in this state lifting said flask, which is used to mold the sand mold, said compacting means, and said filling frame in unison so as to separate said flask from said pattern plate; and removing said separated flask.

7. The method of claim 6, wherein said compacting means includes a plurality of squeeze feet for compacting the molding sand, wherein each squeeze foot is independently, vertically, and separately movable.

8. The method of claim 7, further comprising steps of:

making a protruding or receding profile of a squeeze surface that is defined by all of said squeeze feet; and making a planer profile of the squeeze surface when the squeeze has been completed.

9. A method for molding a sand mold from molding sand that is introduced in a mold space, wherein the mold space is defined by a horizontally fixed pattern plate having a pattern, a vertically movable lower auxiliary frame for surrounding said pattern plate, a vertically movable flask placed above said leveling frame for surrounding the pattern, a vertically movable filling frame placed above said flask, and vertically movable, multi-segmented squeeze feet placed above said flask so that said squeeze feet are insertable into said filling frame, said method comprising the steps of:

supplying an airflow of compressed air to molding sand to be introduced into the mold space so as to fluidize the molding sand, and supplying an additional airflow of compressed air to the fluidized molding sand so as to introduce the fluidized molding sand into the mold space;

lowering said squeeze feet toward said pattern plate in such a manner that said squeeze feet apply a primary squeeze to the introduced molding sand in the mold space;

lowering said filling frame, said flask, said lower auxiliary frame, and said squeeze feet in unison toward said pattern plate in such a manner that said squeeze feet apply a second squeeze to the molding sand; and lifting said filling frame, said flask, said lower auxiliary frame, and said squeeze feet in unison so as to remove the sand mold.

10. The method of claim 9, wherein said removing step includes a step for preventing any undesirable motion of said flask so as to keep the sand mold horizontal.

11. The method of claim 9, further comprising the steps of:

making a protruding or receding profile of a squeeze surface that is defined by said squeeze feet when the mold space is being formed; and making a planer profile of the squeeze surface when the squeeze has been completed.

* * * * *

UNITED STATES PATENT AND TRADEMARK OFFICE

CERTIFICATE OF CORRECTION

PATENT NO. : 6,749,003 B2
APPLICATION NO. : 10/009633
DATED : June 15, 2004
INVENTOR(S) : Kimikazu Kaneto It is certified that error appears in the above-identified patent and that said Letters Patent is hereby corrected as shown below:

Col. 7, line 48, “leveling” should read --lower--.
Col. 9, line 1, “flask 20” should read --flask 18--.
Col. 9, line 6, “leveling” should read --lower--.
Col. 9, line 11, “plate 1a” should read --plate 10a--.
Col. 9, lines 25-26, “plate 1a” should read --plate 10a--.
Col. 9, line 30, “plate 1a” should read --plate 10a--.
Col. 9, line 60, “leveling” should read --lower--.
Col. 10, line 4, “leveling” should read --lower--.
Col. 10, line 18, “leveling frame 16” should read --lower frame 16a--.
Col. 11, line 8, “leveling frame 16” should read --lower frame 16a--.
Col. 11, line 13, “leveling” should read --lower--.
Col. 11, line 36, “leveling” should read --lower--.
Col. 15, line 56, “leveling” should read --lower--.
Col. 15, line 57, “leveling” should read --lower--.
Col. 16, line 47, “leveling frame” should read --lower auxiliary frame--.
Col. 16, line 51, “moans” should read --means--.
Col. 16, line 55, after “space”, insert --so--.
Col. 17, line 17 and line 28, “leveling frame” should read --lower auxiliary frame--.
Col. 18, line 8, “leveling frame” should read --lower auxiliary frame--.

Signed and Sealed this

Twenty-fourth Day of November, 2009

David J. Kappos

David J. Kappos
*Director of the United States Patent and Trademark Office*